US009022832B1

(12) United States Patent
Skripps

(10) Patent No.: US 9,022,832 B1
(45) Date of Patent: May 5, 2015

(54) TOY SPORTS-PLAYER FIGURE

(76) Inventor: Thomas Keath Skripps, Acton, MA (US)

( * ) Notice: Subject to any disclaimer, the term of this patent is extended or adjusted under 35 U.S.C. 154(b) by 395 days.

(21) Appl. No.: 13/253,818

(22) Filed: Oct. 5, 2011

Related U.S. Application Data

(60) Provisional application No. 61/389,839, filed on Oct. 5, 2010.

(51) Int. Cl.
*A63H 3/20* (2006.01)
*A63H 3/48* (2006.01)

(52) U.S. Cl.
CPC ..... *A63H 3/48* (2013.01)

(58) Field of Classification Search
USPC ..... 446/321, 330, 337, 340, 376, 378, 383
See application file for complete search history.

(56) References Cited

U.S. PATENT DOCUMENTS

| | | | | | |
|---|---|---|---|---|---|
| 1,746,839 | A | * | 2/1930 | Main et al. | 446/100 |
| 2,752,726 | A | * | 7/1956 | Calverley | 446/99 |
| 3,124,901 | A | * | 3/1964 | Beebe | 446/383 |
| 3,785,648 | A | * | 1/1974 | Kobayashi | 273/108.51 |
| D231,706 | S | | 5/1974 | Christiansen | |
| 3,862,513 | A | * | 1/1975 | Isaacson et al. | 446/381 |
| 3,874,113 | A | * | 4/1975 | Beck | 446/378 |
| 3,938,277 | A | * | 2/1976 | Goldfarb et al. | 446/384 |
| 3,946,517 | A | * | 3/1976 | Goldfarb et al. | 446/383 |
| 3,962,819 | A | | 6/1976 | Christiansen | |
| 3,995,395 | A | * | 12/1976 | Rahmstorf | 446/100 |
| 4,063,381 | A | * | 12/1977 | Deulofeu | 446/98 |
| 4,078,800 | A | * | 3/1978 | Goldfarb et al. | 273/317.7 |
| 4,103,451 | A | * | 8/1978 | Kawada et al. | 446/99 |
| 4,136,481 | A | * | 1/1979 | Nicholls | 446/381 |
| D253,711 | S | | 12/1979 | Christiansen | |
| 4,185,412 | A | * | 1/1980 | Rahmstorf | 446/98 |
| 4,190,982 | A | * | 3/1980 | Rahmstorf | 446/384 |
| 4,203,248 | A | | 5/1980 | Tapdrup | |
| 4,205,482 | A | | 6/1980 | Christiansen | |
| 4,214,403 | A | | 7/1980 | Knudsen | |
| 4,262,445 | A | * | 4/1981 | Orenstein | 446/308 |
| 4,274,224 | A | * | 6/1981 | Pugh et al. | 446/375 |
| 4,279,419 | A | * | 7/1981 | Barnes et al. | 273/108.22 |
| D278,735 | S | | 5/1985 | Nielsen | |
| 4,519,786 | A | * | 5/1985 | Larws | 446/97 |
| 4,597,574 | A | * | 7/1986 | Wolfe | 273/403 |
| D285,222 | S | | 8/1986 | Nakata | |
| 4,643,691 | A | * | 2/1987 | Keiji | 446/97 |
| 4,824,414 | A | * | 4/1989 | Goldblatt | 446/226 |
| 4,894,040 | A | | 1/1990 | Bach | |
| 4,950,912 | A | | 8/1990 | Goldfarb | |
| 4,968,282 | A | * | 11/1990 | Robson et al. | 446/376 |
| 4,988,324 | A | | 1/1991 | Ryaa | |
| 5,049,104 | A | | 9/1991 | Olsen | |
| D325,605 | S | | 4/1992 | Holmstrom | |
| D329,069 | S | | 9/1992 | Holmstrom | |
| D329,070 | S | | 9/1992 | Holmstrom | |

(Continued)

*Primary Examiner* — Gene Kim
*Assistant Examiner* — Joseph B Baldori
(74) *Attorney, Agent, or Firm* — Barnes & Thornburg LLP

(57) ABSTRACT

Disclosed herein is a mini-figure that may be used with existing and standard toy block systems and also have the appearance of a sports figure. Improvements over traditional mini-figures include additional separate components in the arms and feet, an optional variation in torso shape, accessories which create visual impression of sports figures in natural use, unique markings identifiable by specific player or production, and a unique method of marketing and distribution.

20 Claims, 42 Drawing Sheets

(56) References Cited

U.S. PATENT DOCUMENTS

| | | | | | |
|---|---|---|---|---|---|
| 5,322,466 | A | | 6/1994 | Bolli | |
| 5,340,348 | A | * | 8/1994 | Schroeder | 446/73 |
| D350,791 | S | | 9/1994 | Refsing | |
| D352,078 | S | | 11/1994 | Bertrand | |
| D353,856 | S | | 12/1994 | Ryaa | |
| D358,622 | S | | 5/1995 | Skov | |
| D366,076 | S | | 1/1996 | Pedersen | |
| 5,580,295 | A | | 12/1996 | Ruzskai | |
| 5,588,898 | A | * | 12/1996 | Ooba | 446/321 |
| 5,628,669 | A | * | 5/1997 | Hesse | 446/382 |
| 5,690,330 | A | * | 11/1997 | Ozawa | 273/108.56 |
| D387,105 | S | | 12/1997 | Thomsen | |
| D408,142 | S | | 4/1999 | Song | |
| 5,890,944 | A | * | 4/1999 | Wiggs et al. | 446/135 |
| 5,913,706 | A | * | 6/1999 | Glickman et al. | 446/97 |
| D412,946 | S | | 8/1999 | Pagel | |
| 5,964,635 | A | | 10/1999 | Krog | |
| 6,012,963 | A | * | 1/2000 | Lee | 446/385 |
| D420,064 | S | * | 2/2000 | Poirier et al. | D21/621 |
| 6,033,284 | A | * | 3/2000 | Rodriguez Ferre | 446/383 |
| 6,089,950 | A | * | 7/2000 | Lee et al. | 446/376 |
| 6,098,323 | A | * | 8/2000 | McGuiness | 40/124.191 |
| 6,179,685 | B1 | * | 1/2001 | Toft | 446/390 |
| 6,247,993 | B1 | * | 6/2001 | Feldman | 446/307 |
| 6,287,166 | B1 | * | 9/2001 | Lee et al. | 446/376 |
| D466,564 | S | | 12/2002 | Manville | |
| 6,554,675 | B1 | | 4/2003 | Nyengaard | |
| 6,663,462 | B1 | * | 12/2003 | Bettendorf et al. | 446/369 |
| 6,692,332 | B2 | * | 2/2004 | Jheow | 446/383 |
| D494,643 | S | | 8/2004 | Bresciani | |
| 6,817,921 | B2 | * | 11/2004 | Chin et al. | 446/376 |
| 6,893,318 | B2 | * | 5/2005 | Søviknes et al. | 446/379 |
| D516,135 | S | | 2/2006 | Kim | |
| D539,364 | S | | 3/2007 | Sofussen | |
| D594,870 | S | | 6/2009 | Leung | |
| 7,553,209 | B1 | * | 6/2009 | Sorensen | 446/124 |
| 7,665,607 | B1 | * | 2/2010 | Hanan | 206/457 |
| D611,108 | S | | 3/2010 | Bodin | |
| 8,308,524 | B2 | * | 11/2012 | deFelice et al. | 446/375 |
| 2002/0094750 | A1 | * | 7/2002 | Perse | 446/268 |
| 2003/0162477 | A1 | * | 8/2003 | Jheow | 446/376 |
| 2004/0171328 | A1 | * | 9/2004 | Soviknes et al. | 446/376 |
| 2004/0198161 | A1 | * | 10/2004 | Annis et al. | 446/331 |
| 2005/0112984 | A1 | * | 5/2005 | Hawthorne et al. | 446/21 |
| 2005/0170740 | A1 | * | 8/2005 | Kleinman | 446/97 |
| 2007/0087651 | A1 | * | 4/2007 | Ali | 446/137 |

* cited by examiner

FIG. 2A
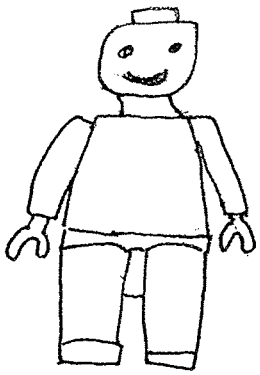
FIG. 2B
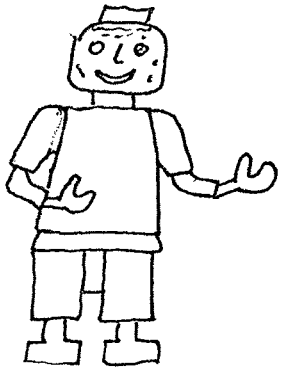
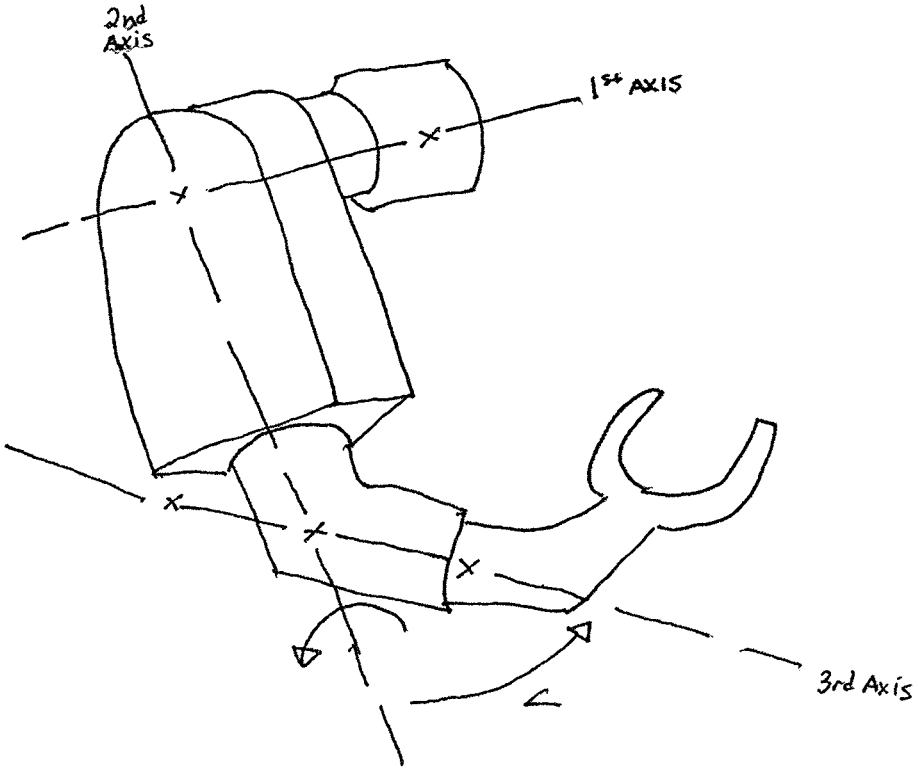
FIG. 3

PLAYER STATS

| YEAR | AB | AVG | BB | H | HR | 3B | 2B | 1B | R | E |
|---|---|---|---|---|---|---|---|---|---|---|
| 2007 | 50 | 0.5 | 5 | 25 | 1 | 2 | 2 | 20 | 9 | 2 |
| 2008 | 50 | 0.5 | 5 | 25 | 1 | 2 | 2 | 20 | 9 | 2 |
| 2009 | 50 | 0.5 | 5 | 25 | 1 | 2 | 2 | 20 | 9 | 2 |
| 2010 | 50 | 0.5 | 5 | 25 | 1 | 2 | 2 | 20 | 9 | 2 |

Fig. 26
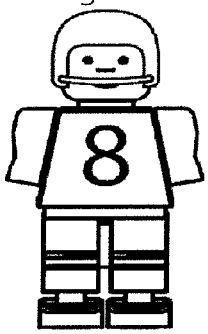
Fig. 27
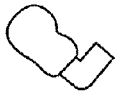
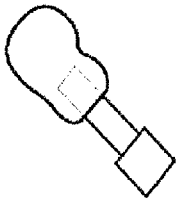
FIG. 30
Fig. 28
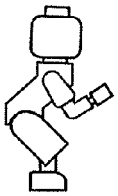
Fig. 29
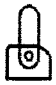
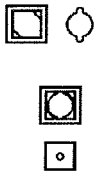
FIG. 31
FIG. 32
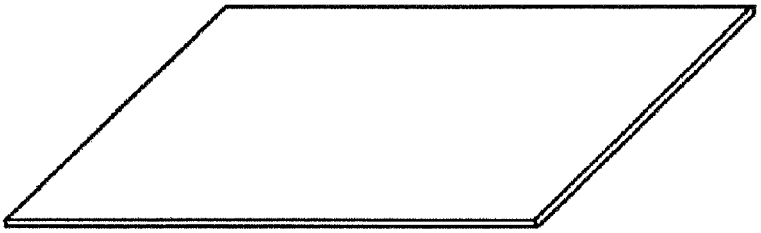
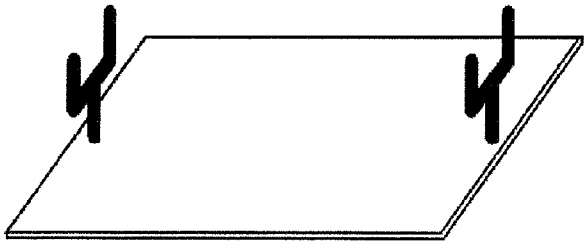
FIG. 33

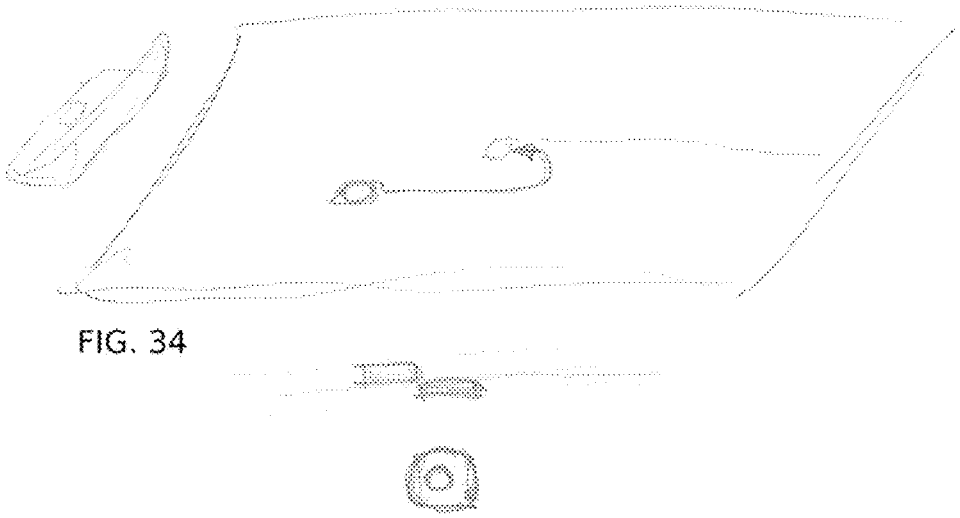
FIG. 34
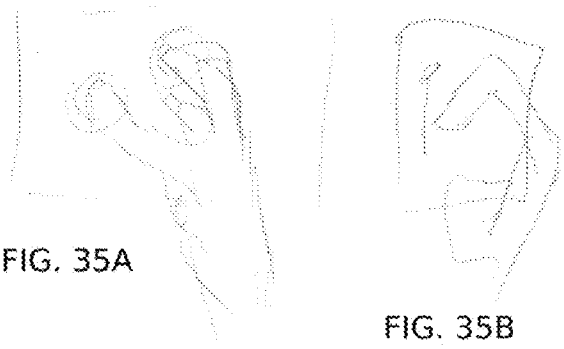
FIG. 35A
FIG. 35B

△1 VARIABLE RADIUS: TRANSITION FROM R.040 TO .005 TO .040

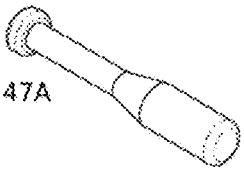
FIG. 47A
FIG. 47B
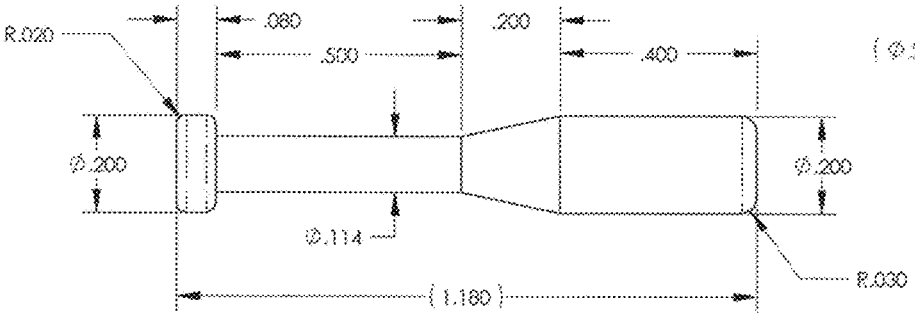
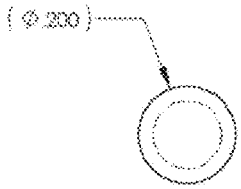
FIG. 47C

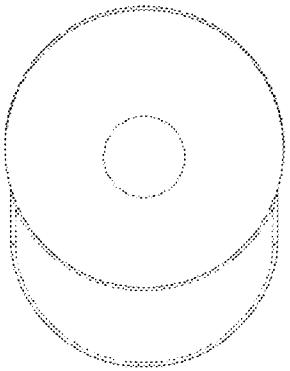
FIG. 63A
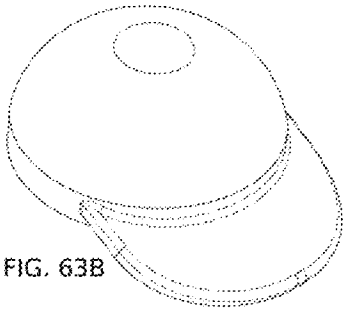
FIG. 63B
FIG. 63C
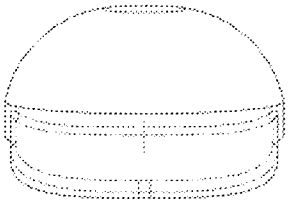
FIG. 63D
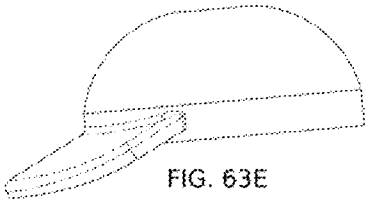
FIG. 63E
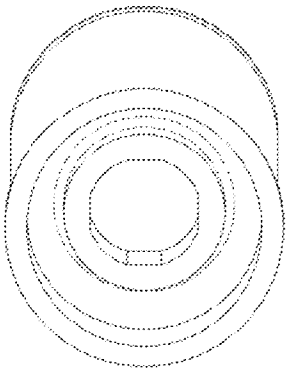
FIG. 63F
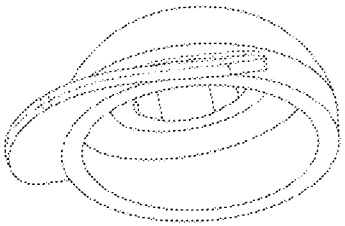
FIG. 63G

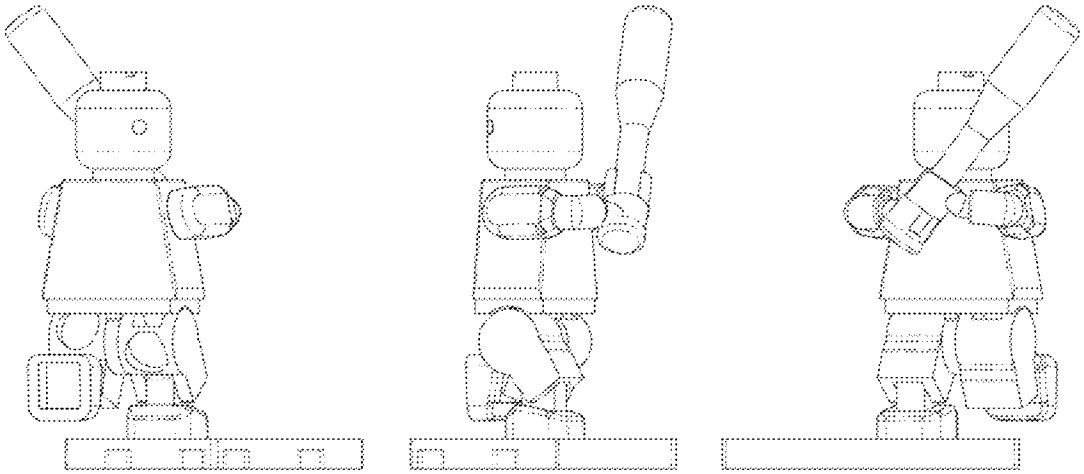
FIG. 65A
FIG. 65B
FIG. 65C
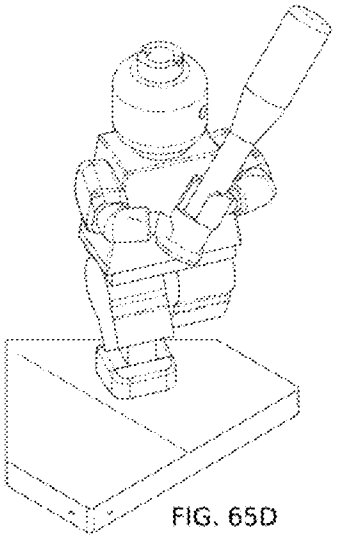
FIG. 65D
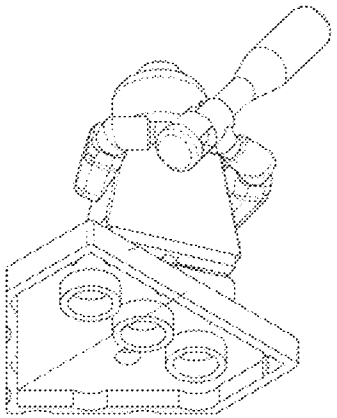
FIG. 65E

TOY SPORTS-PLAYER FIGURE

CROSS-REFERENCE TO RELATED APPLICATIONS

This utility patent application claims priority from U.S. provisional patent application Ser. No. 61/389,839, filed Oct. 5, 2010, titled "TOY SPORTS-PLAYER FIGURINE" in the name of THOMAS KEATH SKRIPPS.

COPYRIGHT NOTICE

A portion of the disclosure of this patent document contains material that is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. Copyright 2011, Oyo Sportstoys, Inc.

BACKGROUND

1. Field of the Disclosure

The disclosure relates to toys, and more specifically to toy mini-figures depicting sports figures and connectable to toy construction block playsets.

2. Background

Toy construction block mini-figures come in many sizes and shapes. A standardized size and shape has been established by dominance of Lego brand blocks. A standard block, and connector type, allows manufacture of mini-figures for use with the standard block and connector for ready acceptance by consumers. Typically mini-figures are marked as components with painted features in component batches, and assembled into the desired mini-figure by selecting the appropriate component.

Legos and similar building blocks are long existing toys. Initial figurines were scaled to connect to a single tab on the blocks. At that scale, no moving parts were includes, but rather single "blocks" were decorated to appear as figurines.

The original Lego mini-figure can be seen in U.S. Design Pat. No. D253,711 (Christiansen et al., Dec. 18, 1979) and U.S. Pat. No. 4,205,482 (Christiansen et al., Jun. 3, 1980). These mini-figures, about 1.5 inches tall, include a head attached to a torso component, two arm components which pivot at the connection to the torso in the shoulder region, a hip component connected to the bottom of the torso, and two leg components connected to and pivotal from the hip component. Feet are part of the bottom of the legs, with recesses or channels in the back of the legs and bottom of the feet allowing connection to studs from building blocks. Curved hand components extend out of each arm. To create different character mini-figures, different designs, stickers, or coloring may be affixed to different components. Assembling different sets of components based on the same theme may create the appearance of specific characters. Accessories may be held in the hands or connect to the head, such as weapons, tools, hair, hats, or helmets.

Variations have been introduced since the original mini-figure. Larger figures have been created. Themed figures have been created. Specialized components have been created for specific creatures, such as an empty-skeleton torso and related arms and legs for a skeleton. However the shape and points of motion of the mini-figure has largely remained unchanged. This is largely due to the durability and scale needed.

BRIEF SUMMARY

Disclosed herein is a mini-figure that may be used with existing and standard toy block systems and also have the appearance of a sports figure. Improvements over traditional mini-figures include additional separate components in the arms and feet, an optional variation in torso shape, accessories which create visual impression of sports figures in natural use, unique markings identifiable by specific player or production, and a unique method of marketing and distribution.

An embodiment includes creation of the arm through two components—a shoulder component and a forearm component. The shoulder component may connect to the torso as traditional arms of mini-figures connect. The forearm may connect to the shoulder such that the forearm may pivot at the connection. This allows two points of motion for an arm, allowing hands connected to both arms to come into alignment such as for holding a baseball bat in a traditional baseball grip.

An embodiment includes a foot component which is connectable to and a leg and may pivot from that connection. Separation into a separate foot component allows positioning into active poses by bending at both the ankle and waste, such as creation of a running pose or batting stance, while still allowing the feet to rest on a flat surface or connect to traditional tabs on toy blocks.

Optional embodiments include variation of the traditional torso component. The torso may be made from multiple separable components, such as for creation of cheerleaders with variable outfits. Alternatively the torso may have a natural bend depicting typical sports stance, such as may be seen in hockey players.

Sports accessories may be included with sports mini-figures, or included on components of the mini-figures. For example, balls, gloves, and sticks may be included. Stick-like accessories may include narrow regions for grip by hands. Balls and gloves, which traditionally are not grippable by mini-figures, may have one side specifically shaped to fit with traditional mini-figure hand shapes. This allows sports figures to hold their appropriate accessories. In addition to separate pieces, separation of arms and feet allows further customization. For example, shoulder pads may be included on shoulder component and vary by sport, and sport-specific shoe designs may be included on foot components. This allows further customization by component than is possible with single arm or combined foot and leg components.

An embodiment includes unique markings on one or more components in each mini-figure. Mini-figures are traditionally mass produced, but individualization by sets or other indicia allows increased commercial value and collectibility of specific mini-figures.

Along with specific marking, vending machine or interactive displays may be used to distribute mini-figures and increase commercial appeal.

BRIEF DESCRIPTION OF THE DRAWINGS

In the drawings, closely related figures and items have the same number but different alphabetic suffixes. Processes, states, statuses, and databases are named for their respective functions.

FIG. 2A shows a traditional mini-figure and FIG. 2B shows a mini-figure having multi-component arms and separate-component feet, with relative heights approximately equal between both mini-figures.

FIG. 3 shows a shoulder component connected to a forearm component connected to a hand component with axis of rotation illustrated.

FIG. 26 shows a football player mini-figure.

FIG. 27 shows an arm of a football player mini-figure with pads and muscles.

FIG. 28 shows a hockey player mini-figure.

FIG. 29 shows a bending forearm component.

FIG. 30 shows a foot component designed to appear as a hockey skate.

FIG. 31 shows a magnetic insert that fits into a foot component.

FIG. 32 shows a magnetic surface.

FIG. 33 shows a magnetic surface appearing to be a football field.

FIG. 34 shows a virtual/real playing surface having controlled locations of magnetic position, with magnets also shown having a magnetic core surrounded by a buffer zone.

FIG. 35A and FIG. 35B show touch-based controls of the magnetic playing surface.

FIG. 38A shows a perspective view, FIG. 38B shows a top-down view, FIG. 38C shows a wide-side view; FIG. 38D shows a bottom-up view, and FIG. 38E shows a narrow-side view.

FIG. 39A shows a perspective view, FIG. 39B shows a side view of the component laid flat, FIG. 39C shows a view looking into the hand-side end, FIG. 39D shows a side view of the component tilted up, and FIG. 39E shows an interior slice view.

FIG. 40A shows a perspective view, FIG. 40B shows an end view, FIG. 40C shows top view, FIG. 40D shows a side view, and FIG. 40E shows an interior slice view.

FIG. 41A shows a perspective view, FIG. 41B shows a side view, FIG. 410 shows a close up view of the connector the enters the torso component, FIG. 41D shows torso-side view, and FIG. 41E shows a forearm-end view.

FIG. 42A shows a perspective view, FIG. 42B shows a top view, FIG. 42C shows a back view, FIG. 42D shows a side view, FIG. 42E shows an interior slice view, and FIG. 42F shows a close-up view of the ear.

FIG. 43A shows a perspective view, FIG. 43B shows a top view, FIG. 43C shows a front view, and FIG. 43D shows a side view.

FIG. 44A shows a perspective view, FIG. 44B shows a bottom view, FIG. 44C shows an interior slice view from the side, FIG. 44D shows a side view, FIG. 44E shows an interior slice view from the front, FIG. 44F shows a back view.

FIG. 45A shows a perspective view, FIG. 45B shows a bottom view, FIG. 45C shows a side view, FIG. 45D shows a front view, FIG. 45E shows an interior slice view, and FIG. 45F shows another interior slice view.

FIG. 46A shows a perspective view, FIG. 46B shows a bottom view, FIG. 46C shows a side view, FIG. 46D shows an interior slice view, and FIG. 46E shows a back view.

FIGS. 47A-C show multiple views of a bat accessory. FIG. 47A shows a perspective view. FIG. 47B shows a side view, and FIG. 47C shows a top view.

FIG. 48A shows a perspective view, FIG. 48B shows a top view, FIG. 48C shows a side view, FIG. 48D shows a bottom view, FIG. 48E shows a front view, and FIG. 48F shows an interior slice view.

FIG. 49A shows a perspective view, FIG. 49B shows a top view, FIG. 49C shows a side view, FIG. 49D shows a back view, and FIG. 49E shows an interior slice view.

FIG. 50A shows a perspective view, FIG. 50B shows a top view, FIG. 50C shows an interior slice, and FIG. 50D shows another interior slice on a different axis.

FIG. 51A shows a perspective view, FIG. 51B shows a top view, FIG. 51C shows a side view, FIG. 51D shows a front view, and FIG. 51E shows an interior slice view.

FIG. 60A shows a front view, FIG. 60B shows a side view, FIG. 60C shows a back view, FIG. 60D shows a bottom view, FIG. 60E shows a top view, FIG. 60F shows a front view with forearm rotated away from the mini-figure, FIG. 60G shows a running perspective, and FIG. 60H shows a running perspective from the other side.

FIGS. 63A-G show multiple perspective views of a hat accessory.

FIGS. 65A-E show multiple perspective views of a baseball mini-figure holding a bat and standing on a baseball plate with standard block tabs for connectors.

DETAILED DESCRIPTION OF THE INVENTION, INCLUDING THE

Preferred Embodiment

Operation

In the following detailed description of the invention, reference is made to the accompanying drawings which form a part hereof, and in which are shown, by way of illustration, specific embodiments in which the invention may be practiced. It is to be understood that other embodiments may be used, and structural changes may be made without departing from the scope of the present invention.

A preferred embodiment is a mini-figure with improvements over traditional mini-figures allowing more accurate appearance and positioning creating a sports mini-figure. Such improvement is enabled through arm, leg, torso, and accessory features.

Figure 1:
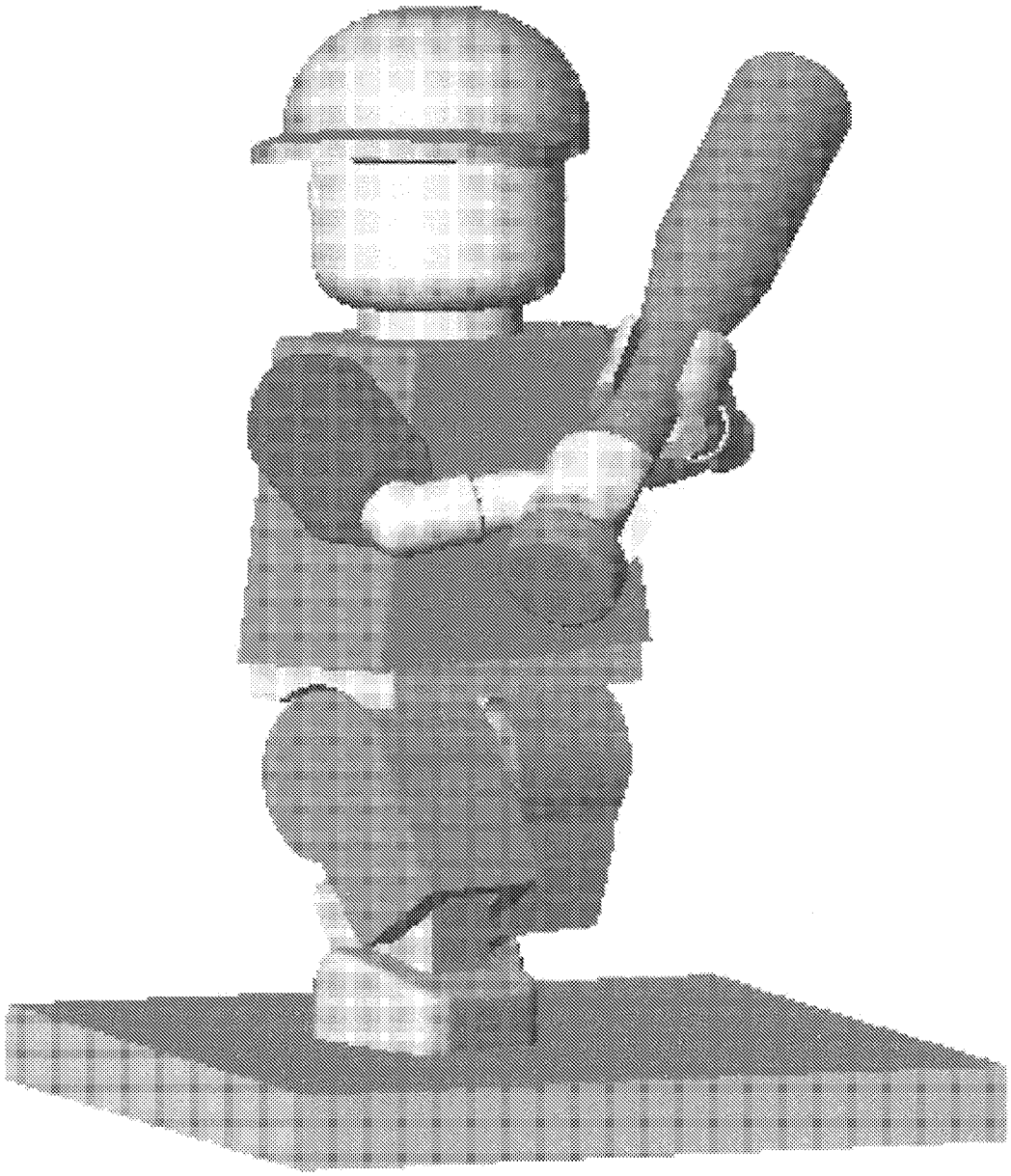
FIG. 1 shows a sports mini-figure holding a bat and connected to a display plate.
Figure 4:
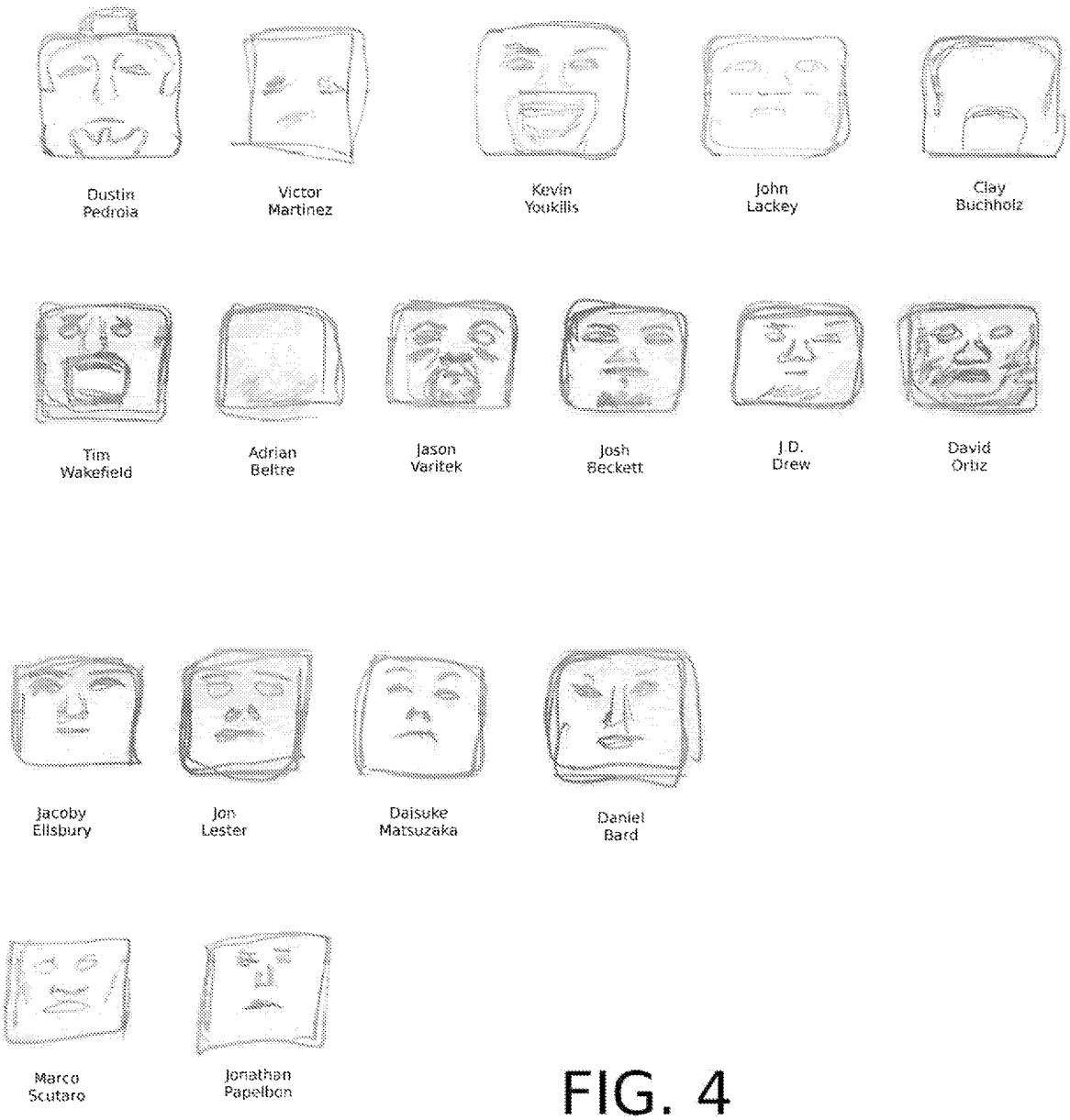
FIG. 4 shows a set of facial designs for head components, in this case a set of baseball players from the same baseball team.
Figure 5:
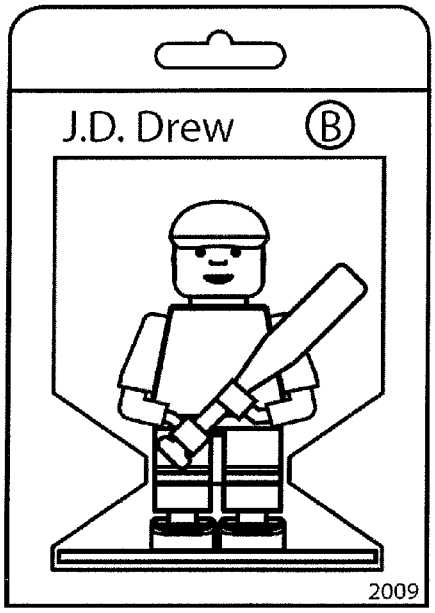
FIG. 5 shows a mini-figure with display plate in a distribution box for display purposes.
Figure 6:
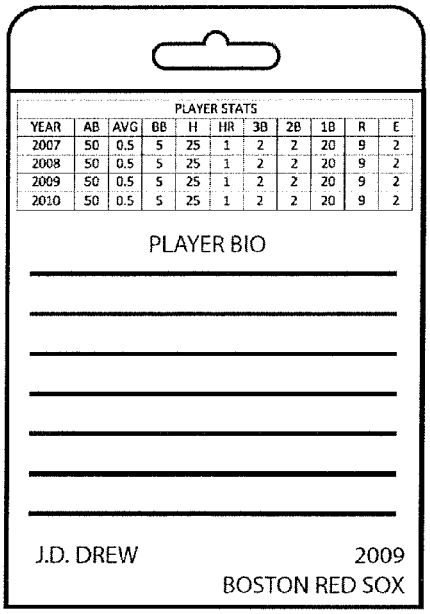
FIG. 6 shows the back of a distribution box.
Figure 7:
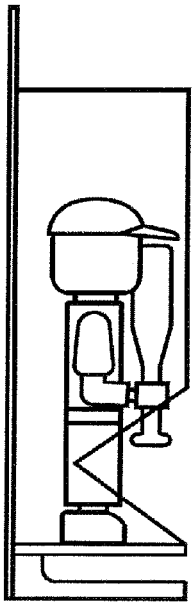
FIG. 7 shows a side view of the distribution box illustrating a clamp-shell design allowing a mini-figure and display plate to be packaged together, including holding the mini-figure in assembled position or stance.

Referring to FIG. 1, a baseball mini-figure is shown holding a bat in a batting position. Such arrangement is not possible with prior mini-figures, as the hands could not be positioned near to each other or across the body to hold a bat as in a baseball bat grip, nor do prior mini-figures bend at an ankle level to allow athletic-looking stances such as a the shown batting stance. Despite these differences, the improved sports mini-figure may be used with prior playsets as if it were a prior mini-figure, and connect to building block tabs the same as prior mini-figures. Referring also to FIG. 2, the improved sports mini-figure is shown to be of the same scale and overall general appearance as a prior mini-figure. In the preferred embodiment, the height of the improved sports mini-figure is approximately 1.56 inches.

Referring also to FIG. 3, a complete arm is shown. The complete arm includes three components, an upper arm or shoulder component (see also FIG. 41), a forearm component (see also FIG. 39), and a hand component (see also FIG. 40). The upper arm component connects to the torso, where the connection may be the same as in prior mini-figures, allowing the arm to pivot in a plane adjacent to the side of the torso. The forearm component connects to the upper arm component through an interference-fitted cylindrical connection. The forearm component may be bent at an angle just below the end of connection to the upper arm component. This provides appearance of a bent elbow. The lower arm may rotate about an axis parallel to the upper arm and defined by a line between the shoulder of the upper arm and elbow of the forearm. This second point of rotation allows the forearm to be positioned across or away from the body of a mini-figure. The hand component connects to the forearm through an interference-fitted cylindrical connection, which may be the same as in prior mini-figures. Inward reach and ability to align hands is enabled by the additional point of rotation and allows the mini-figure to hold a bat in a traditional batting grip or hold sports equipment in both hands in traditional positions associated with the sport.

Referring also to FIGS. 44, 45, and 46, a foot component may be connected to each leg component allowing pivot of the foot up or down while still aligned straight-forward relative to the leg. This allows a point of rotation additional to leg rotation at the hip. This additional point creates a visual appearance of an ankle or knee (a lower-leg point of rotation). This in turn allows positioning into traditional athletic poses, such as a baseball player squatting into a batting stance, a player running, or a pitcher striding to throw. The bottom of the foot component has a recess designed to accept tabs from traditional building blocks, allowing connection of the sports mini-figure to the building block through the foot.

Figure 21:
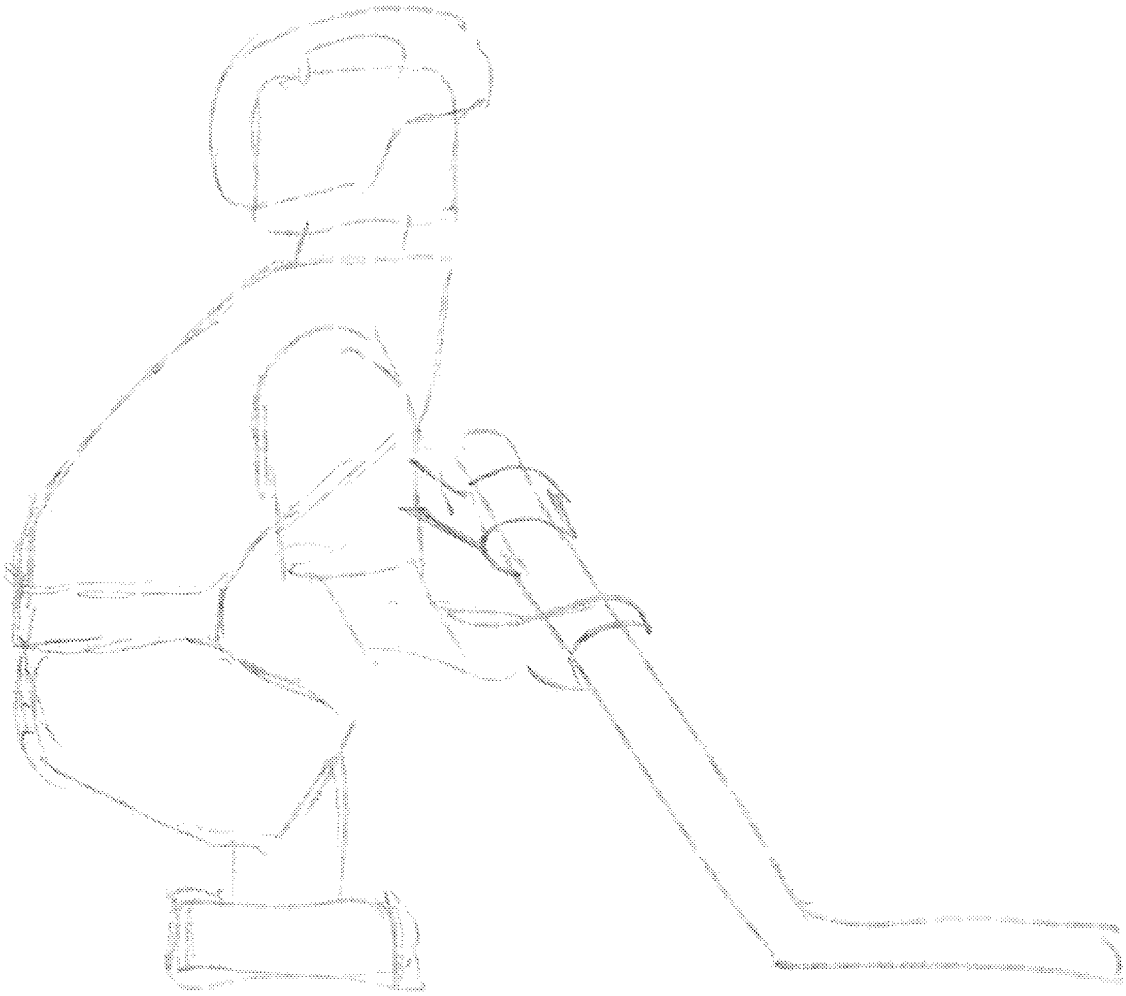
FIG. 21 shows a hockey mini-figure with angled torso.
Figure 22:
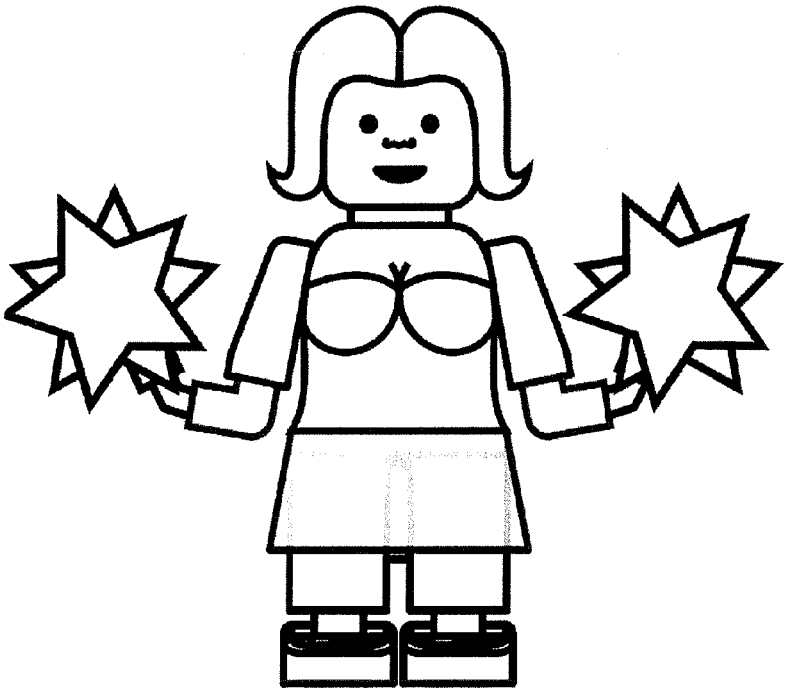
FIG. 22 shows a cheerleader mini-figure.
Figure 23:
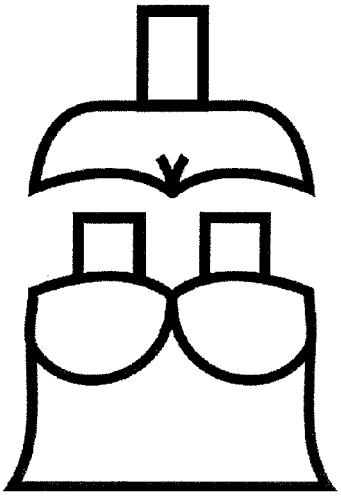
FIG. 23 shows a cheerleader torso separated into two components.

Referring also to FIGS. 21, 22, and 23, some embodiments may include variations in the torso component. A skating hockey player has a traditional bent upper body position. This may be implemented by a torso component having an angled position to the axis of rotation of the head. Alternatively, cheerleaders may be created with non-traditional torso components. The torso component may be comprised of two separate components, allowing an upper chest and lower torso. This allows more accurate mini-figure depiction of cheerleaders, including bikini top, cleavage, skinny waist. Delineation of the torso portions may be either above or below the breasts, but should be consistent across mini-figure cheerleaders to allow consistent swapping of torso sub-components.

Sports accessories may be included with sports mini-figures, or included on components of the mini-figures. Baseball bats, hockey sticks, lacrosse sticks, and other sports equipment may be included. Due to the flexible arm posing enabled by multi-segment arms, bats and sticks may have regions for gripping by the mini-figure hands that correspond to where real-life athletes would grip the bat or stick. Sports balls, gloves, and cheerleading equipment may also be made into accessories. One or two-handed accessories, which traditionally are not grippable by mini-figures, may have one side specifically shaped to fit with traditional mini-figure hand shapes. This allows sports figures to hold their appropriate accessories. Referring to FIGS. 14-20, a baseball glove, baseball, and football are shown with recesses on one side of each accessory allowing fit with mini-figure hands. Such cylindrical cut into the accessory allows interference fit with a hand to hold the accessory and present appearance of the object. Accessories which go together, such as a baseball and glove, may also be sized for interference fit such that the ball may fit and hold within the glove. Referring also to FIGS. 26, 27, 28, and 33, accessories may also be designed onto mini-figure components. For example, shoulder pads may be designed as part of upper-arm components for football players. Different tattoo design may be included in upper-arm components for different basketball players. Ice skates may be designed as part of foot components for hockey players. Different sneaker design may be designed as part of foot components for different athletes. This allows finely tuned specifics of more components, allowing more customization of individual mini-figures than previously possible.

Referring also to FIG. 30, an additional accessory may be a magnetic component which fits into the recess in a foot component. The magnetic component may include a cavity to enable easy removal. Inclusion of the magnetic component enables the mini-figure to secure stably to a flat surface in a standing or athletic position as long as the foot is flat on the surface. Referring also to FIGS. 31 and 32, the surface may be magnetic, and may be shaped and marked as an athletic performance venue such as a sports field, court, or rink. The surface may have localized magnetic positions to allow a player to be restrained or controlled by the location of the magnetic feature. Referring also to FIGS. 33 and 34, moving the magnetic feature may allow the mini-figure to move on the surface, and may be controlled by a user interface.

Figure 8A:
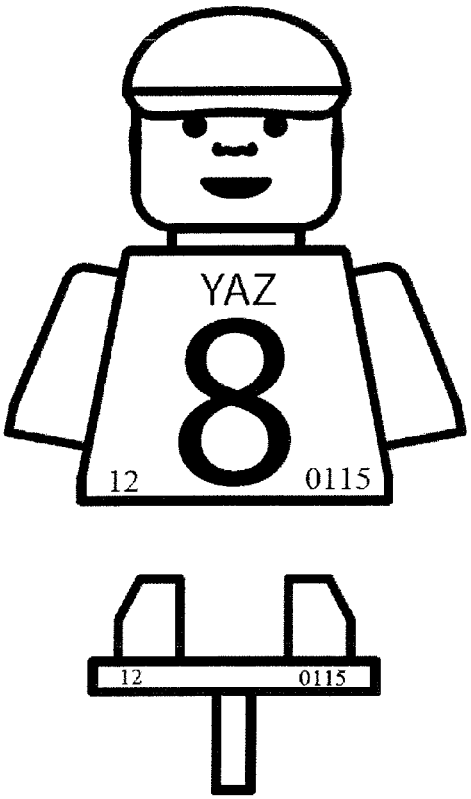
FIG. 8A shows serialized markings on multiple components of a mini-figure, each component bearing the same serialized set number.
Figure 8B:
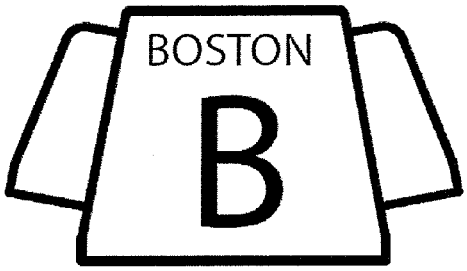
FIG. 8B depicts a printing or label customized for a specific player and component.
Figure 9:
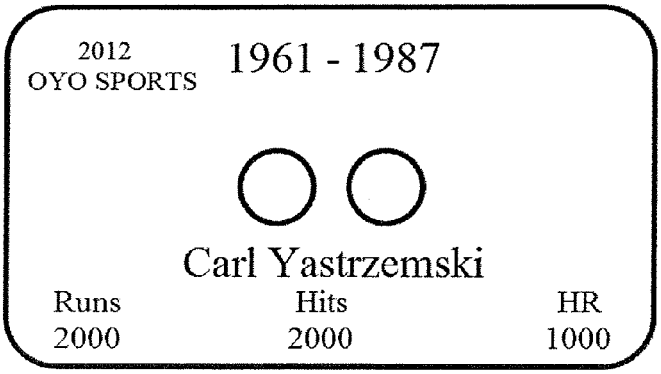
FIG. 9 shows a display plate with sports-related information associated with a specific player.
Figure 10:
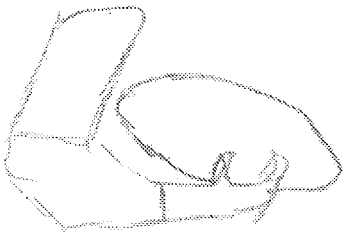
FIG. 10 shows an arm with the hand component holding a football accessory.
Figure 11:
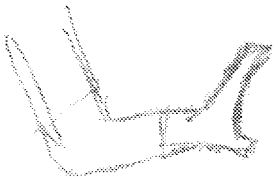
FIG. 11 shows an arm in a stiff-arm block position.
Figure 12:
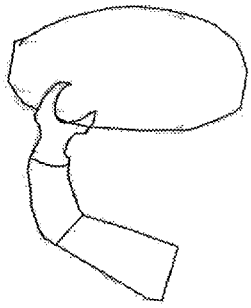
FIG. 12 shows an arm holding a football accessory in a throwing position.
Figure 13:
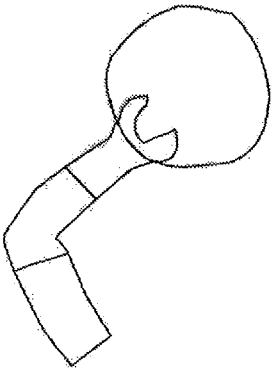
FIG. 13 shows an arm holding a baseball accessory in a throwing position.
Figure 14:
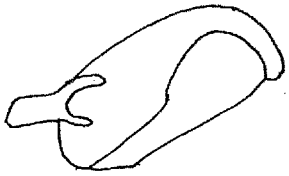
FIG. 14 shows a baseball glove accessory.
Figure 15:
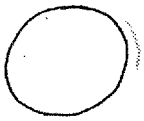
FIG. 15 shows a baseball accessory sized to fit in the baseball glove accessory of FIG. 14.
Figure 16:
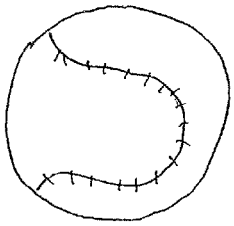
FIG. 16 shows a baseball accessory.
Figure 19:
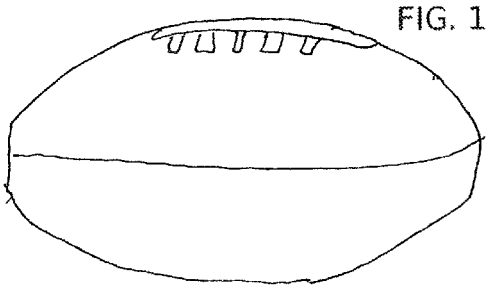
FIG. 19 shows a football accessory.
Figure 17:
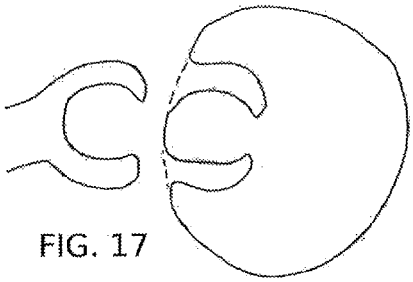
FIG. 17 shows a baseball rotated to reveal a grip nestable within the hand of a mini-figure.
Figure 20:
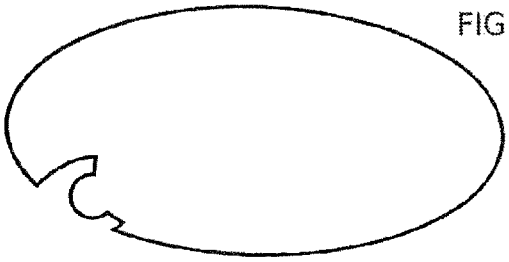
FIG. 20 shows a football rotated to reveal a grip nestable within the hand of a mini-figure.
Figure 18:
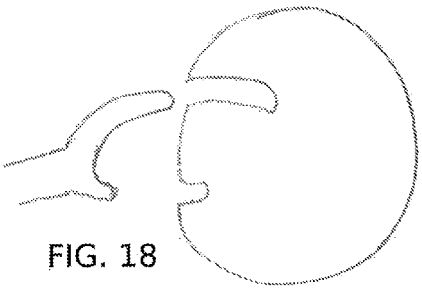
FIG. 18 shows a baseball with the grip partially complete.
Figure 36:
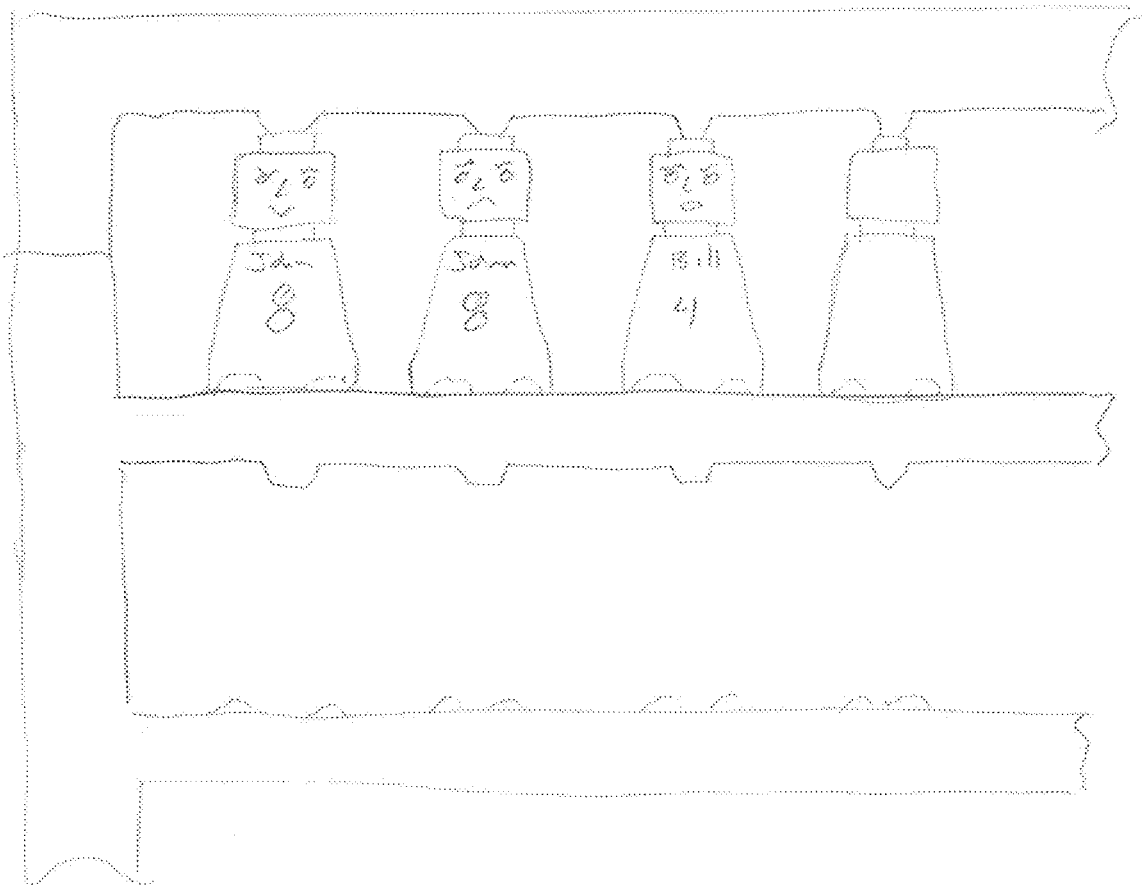
FIG. 36 shows multiple stations for holding and variably printing mini-figure components.
Figure 37:
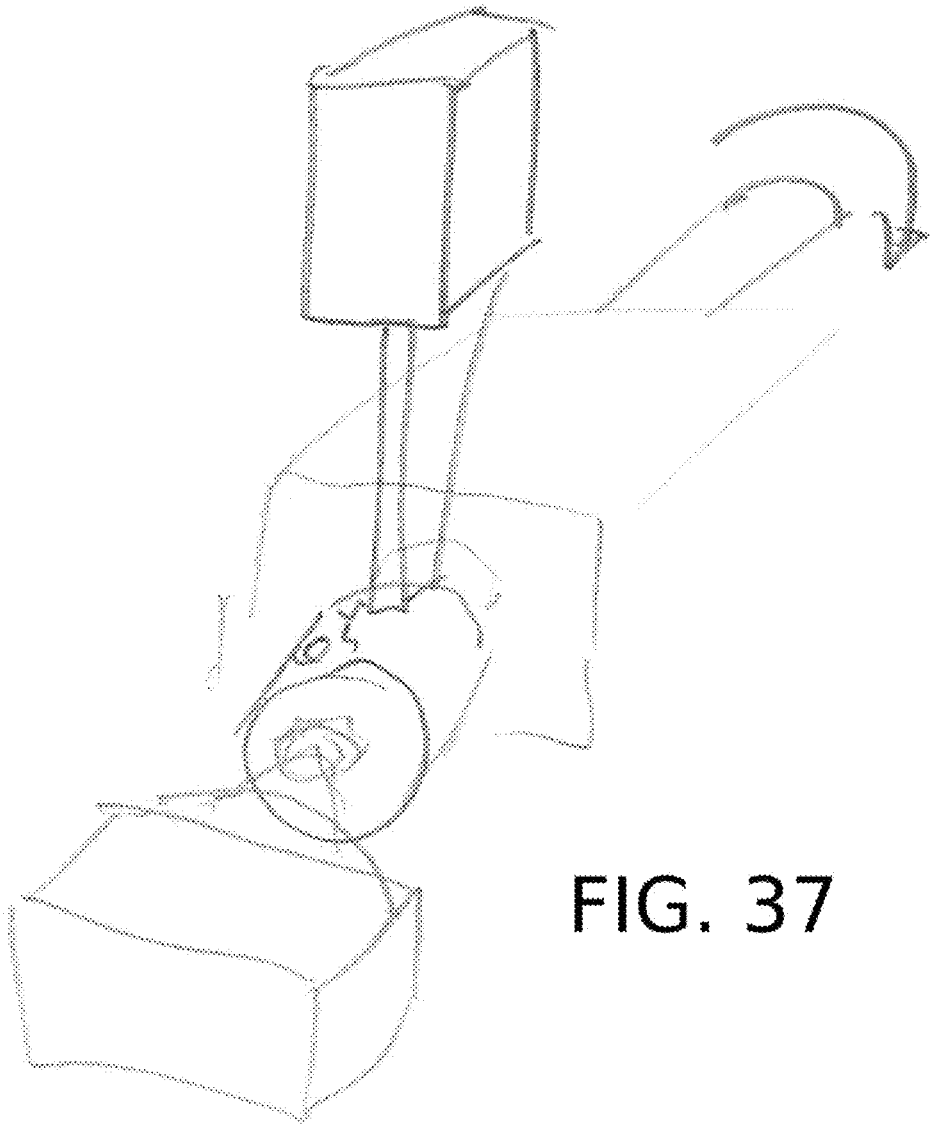
FIG. 37 shows a rotational printing station for printing on mini-figure heads.
Figure 38A:
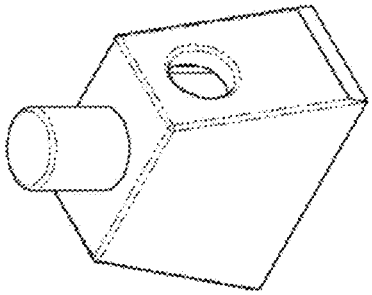
FIGS. 38A-E show multiple views of a torso component.
Figure 38B:
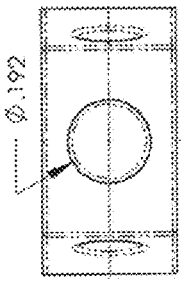
Figure 38C:
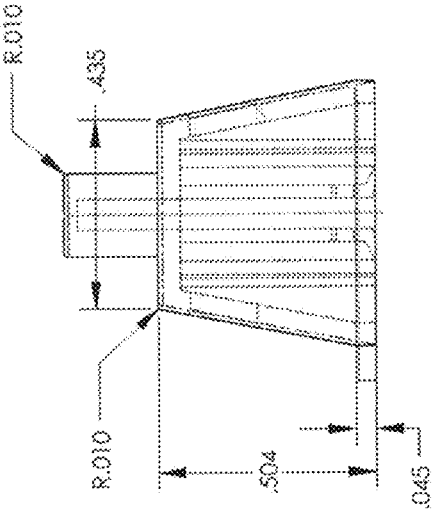
Figure 38E:
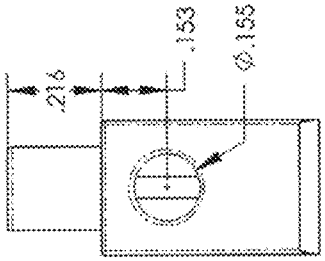
Figure 38D:
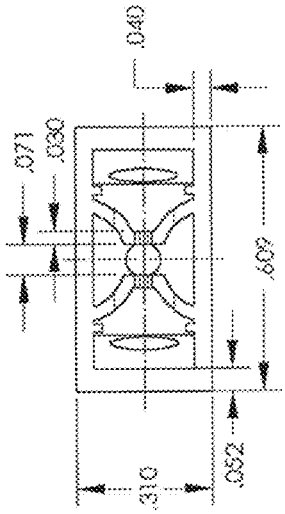
Figure 39A:
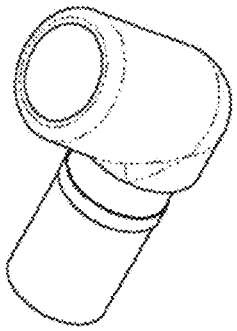
FIGS. 39A-E show multiple views of a forearm component.
Figure 39E:
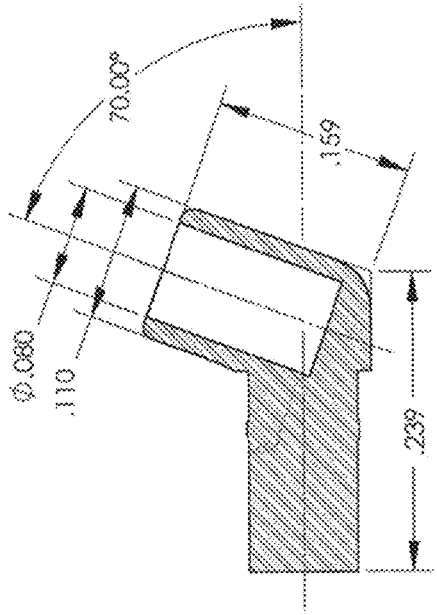
Figure 39B:
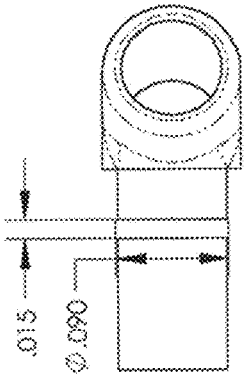
Figure 39D:
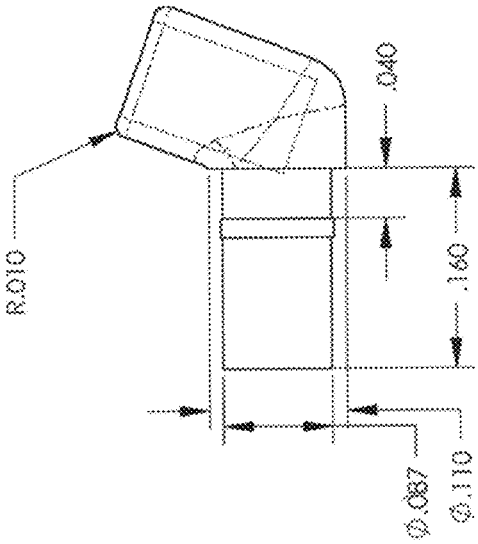
Figure 39C:
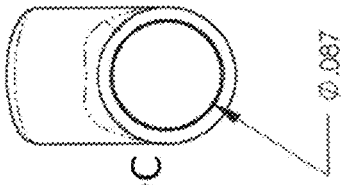
Figure 40B:
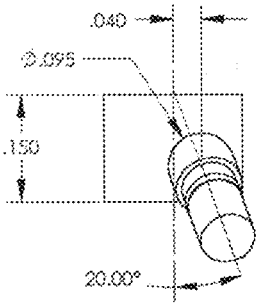
FIGS. 40A-E show multiple views of a hand component.
Figure 40A:
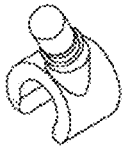
Figure 40C:
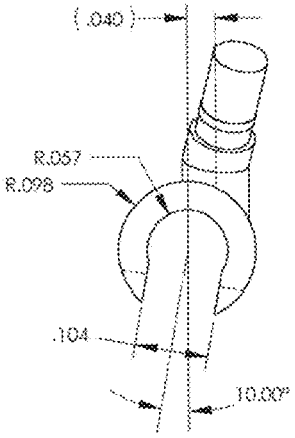
Figure 40D:
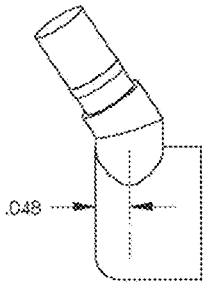
Figure 40E:
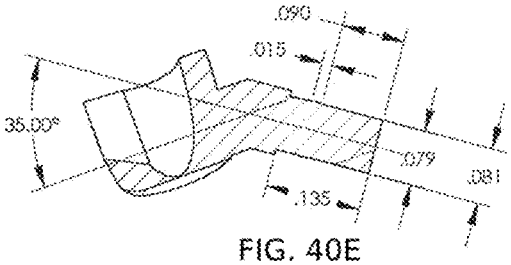
Figure 41A:
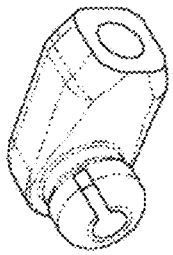
FIGS. 41A-E show multiple views of an upper arm or shoulder component.
Figure 41C:
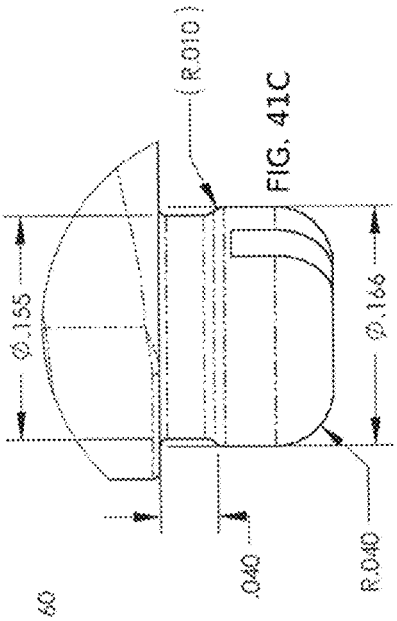
Figure 41E:
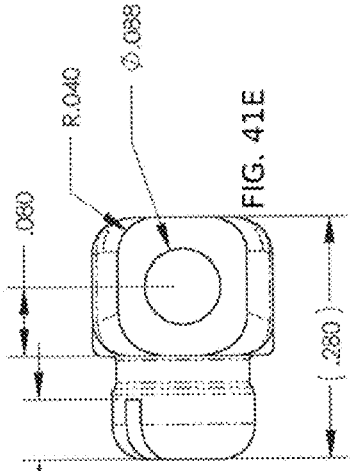
Figure 41B:
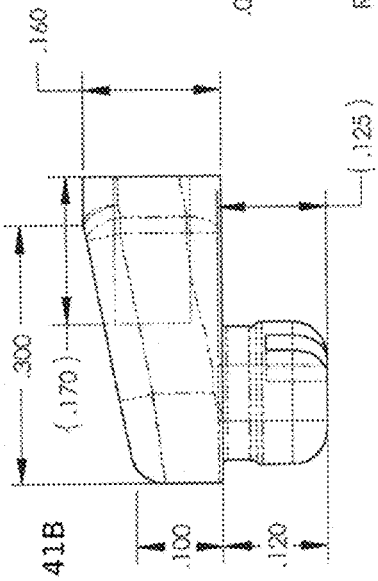
Figure 41D:
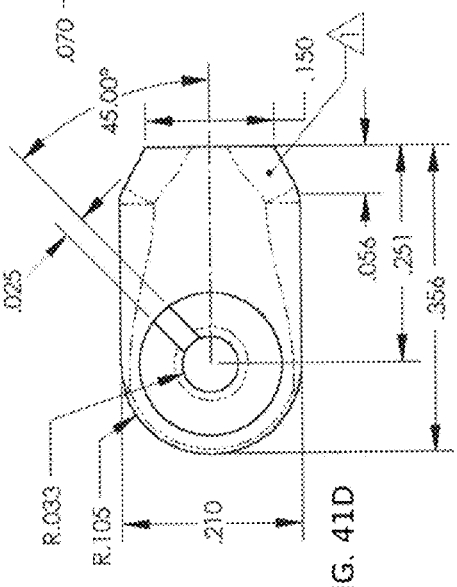
Figure 42B:
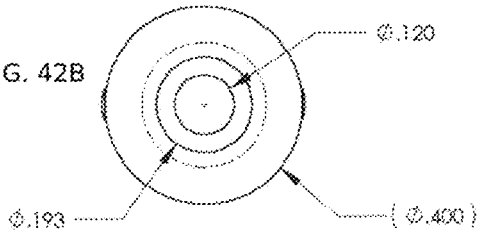
FIGS. 42A-F show multiple views of a head component.
Figure 42F:
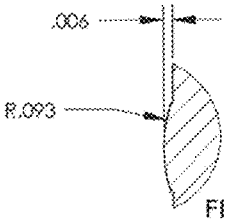
Figure 42A:
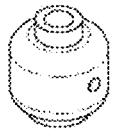
Figure 42C:
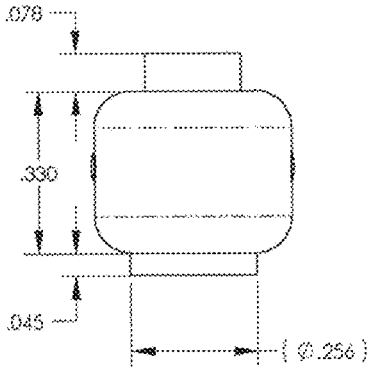
Figure 42D:
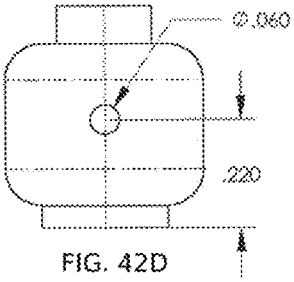
Figure 42E:
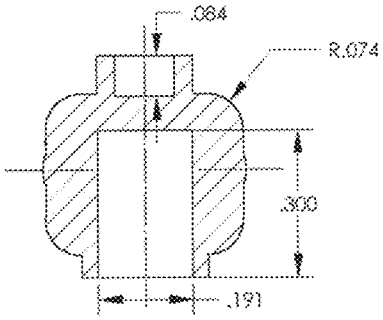
Figure 43B:
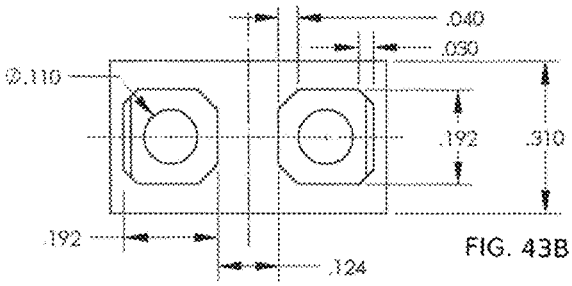
FIGS. 43A-D show multiple views of a hip component.
Figure 43A:
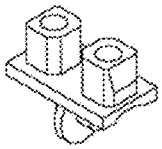
Figure 43C:
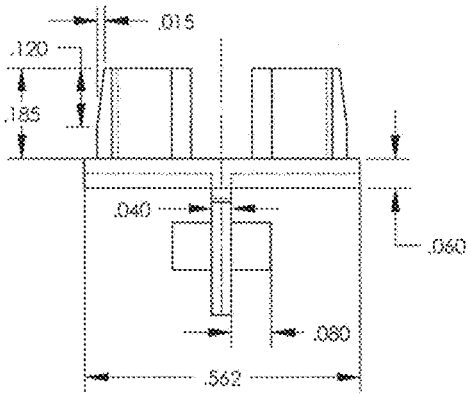
Figure 43D:
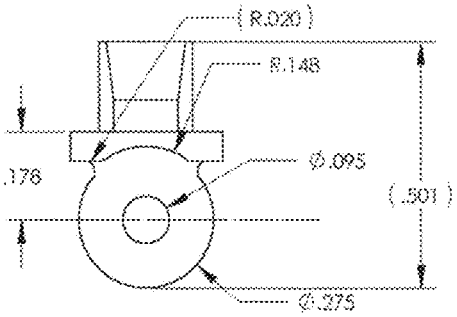
Figure 44B:
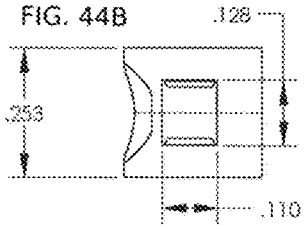
FIGS. 44A-F show multiple views of a left leg component.
Figure 44C:
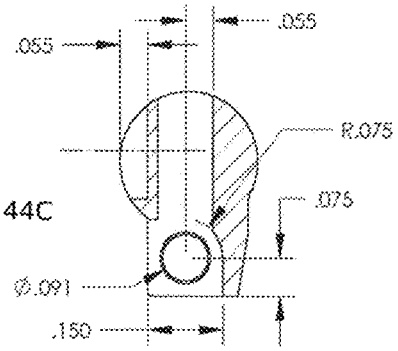
Figure 44A:
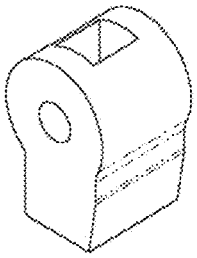
Figure 44D:
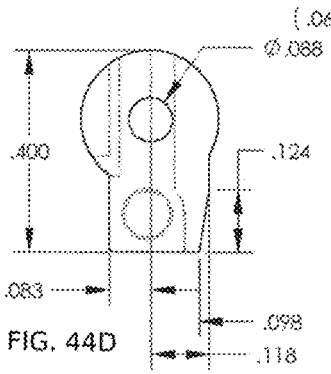
Figure 44E:
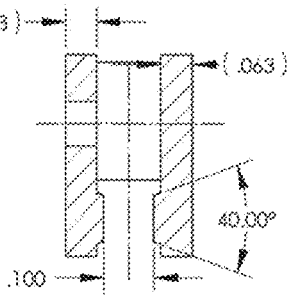
Figure 44F:
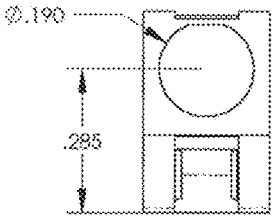
Figure 45A:
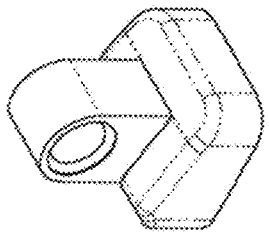
FIGS. 45A-F show multiple views of a foot component.
Figure 45B:
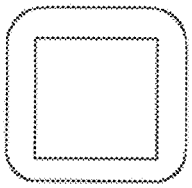
Figure 45E:
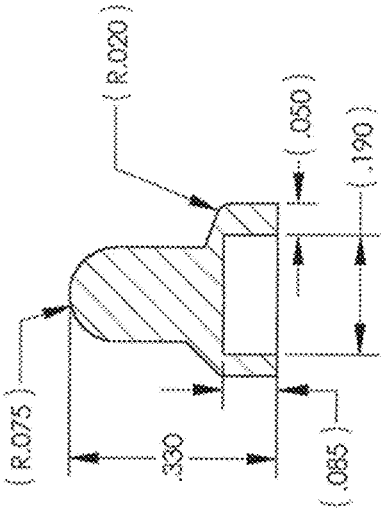
Figure 45D:
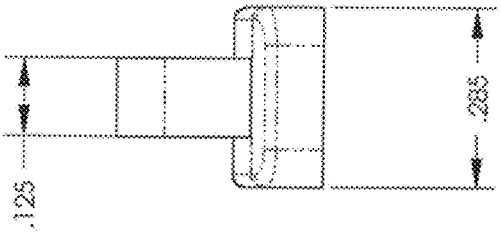
Figure 45F:
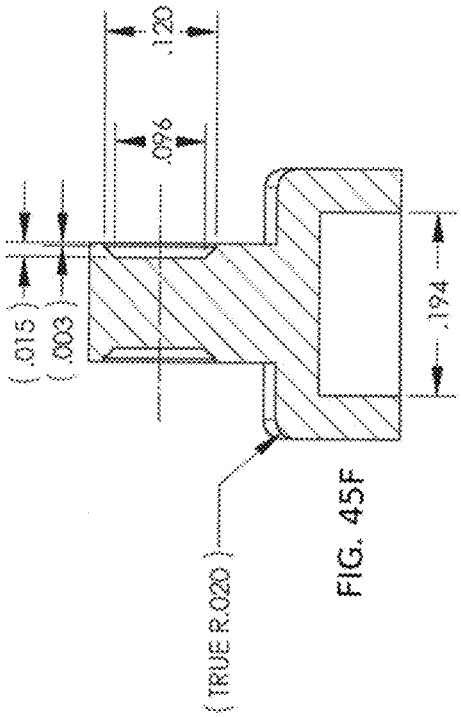
Figure 45C:
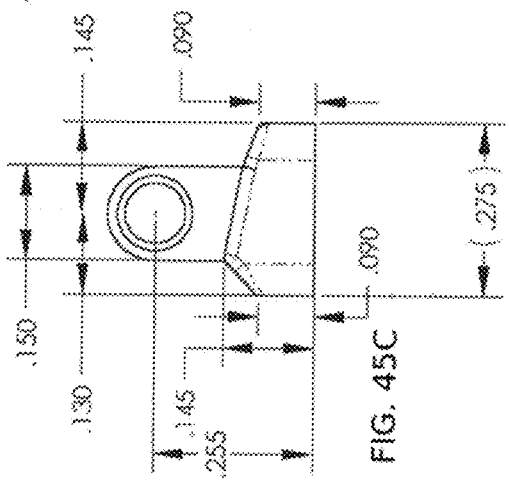
Figure 46A:
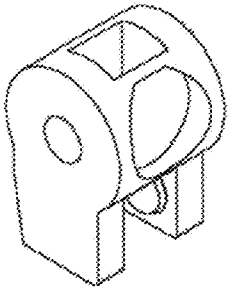
FIGS. 46A-E show multiple views of a right leg component.
Figure 46E:
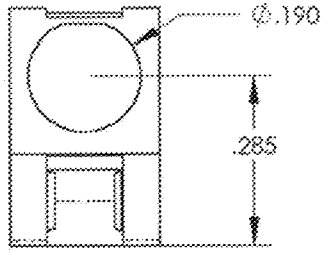
Figure 46D:
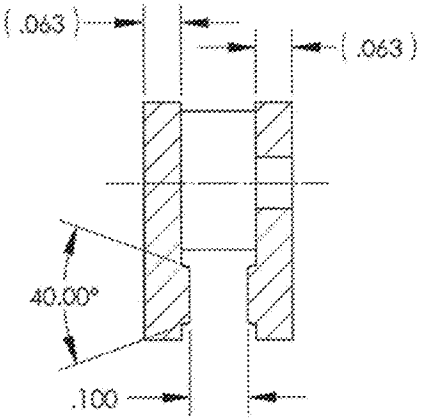
Figure 46B:
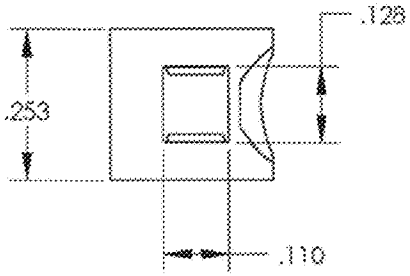
Figure 46C:
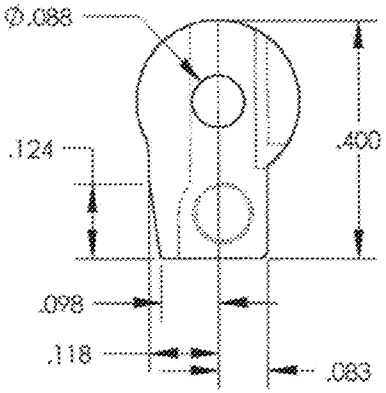
Figure 48B:
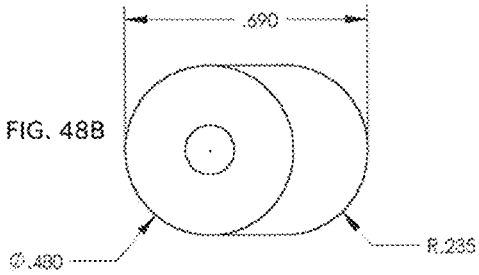
FIGS. 48A-F show multiple views of a hat accessory.
Figure 48F:
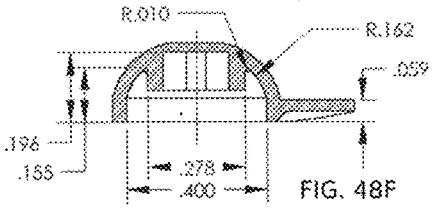
Figure 48A:
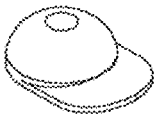
Figure 48C:
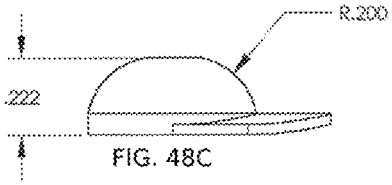
Figure 48E:
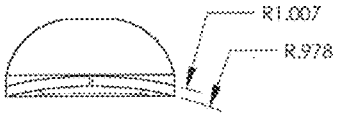
Figure 48D:
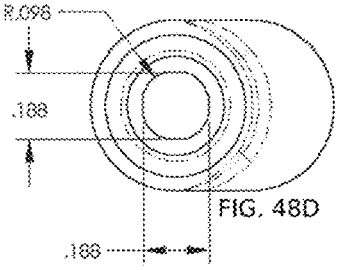
Figure 49B:
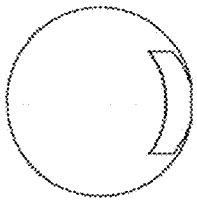
FIGS. 49A-E show multiple views of a ball accessory.
Figure 49E:
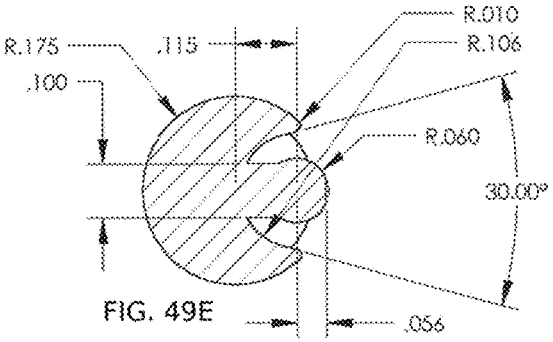
Figure 49A:
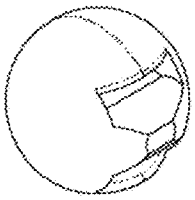
Figure 49C:
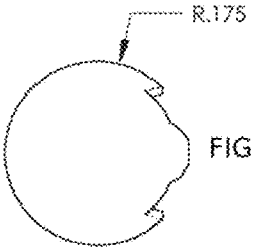
Figure 49D:
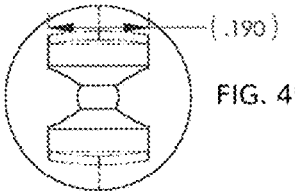
Figure 50A:
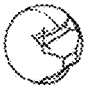
FIGS. 50A-D show multiple views of an alternative ball accessory.
Figure 50B:
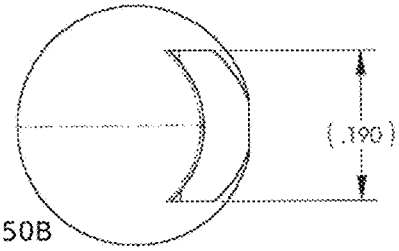
Figure 50D:
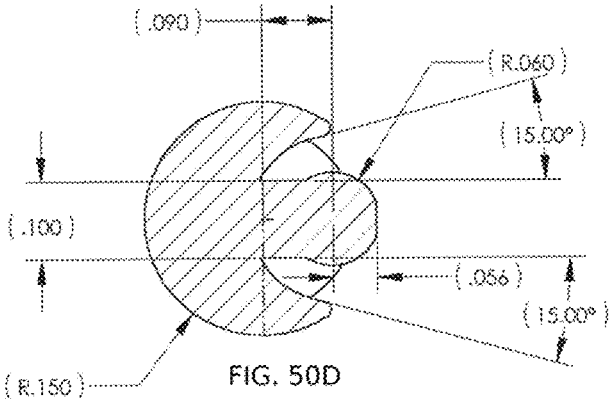
Figure 50C:
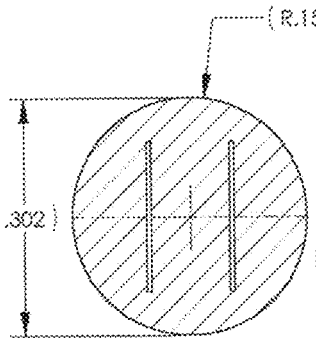
Figure 51A:
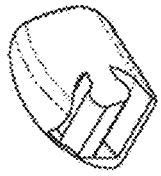
FIGS. 51A-E show multiple views of a baseball glove accessory.
Figure 51E:
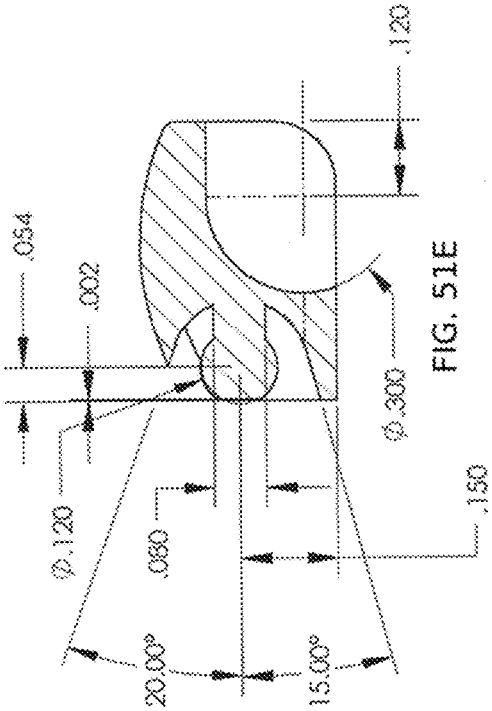
Figure 51D:
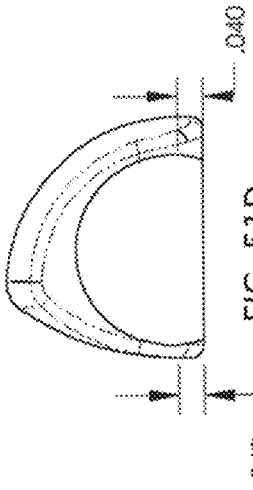
Figure 51B:
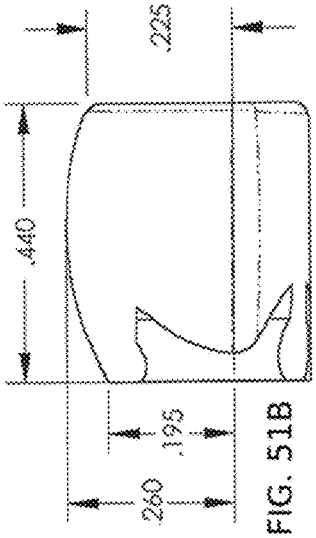
Figure 51C:
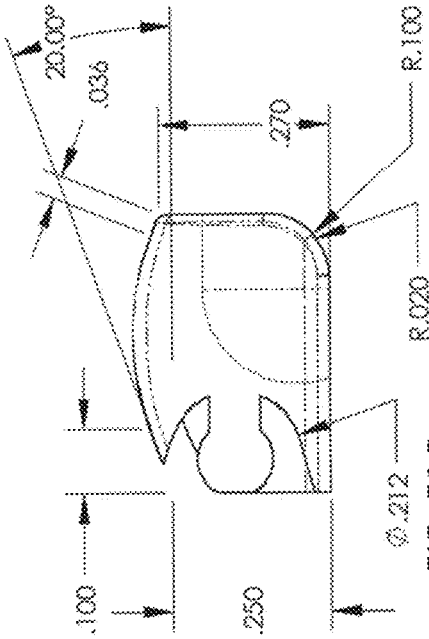
Figure 52:
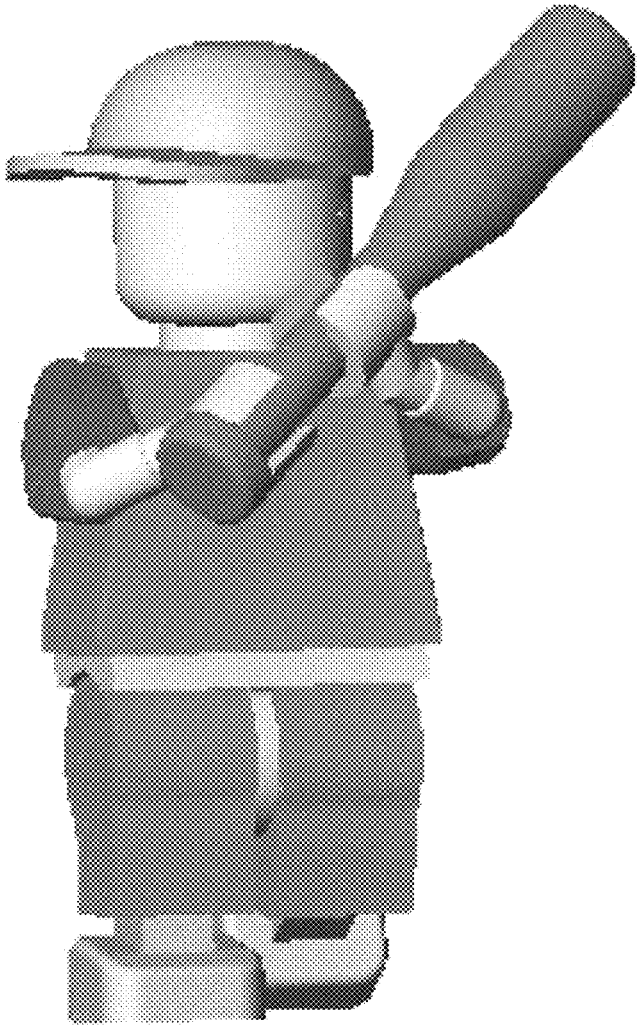
FIG. 52 shows a front view of a baseball mini-figure holding a bat.
Figure 53:
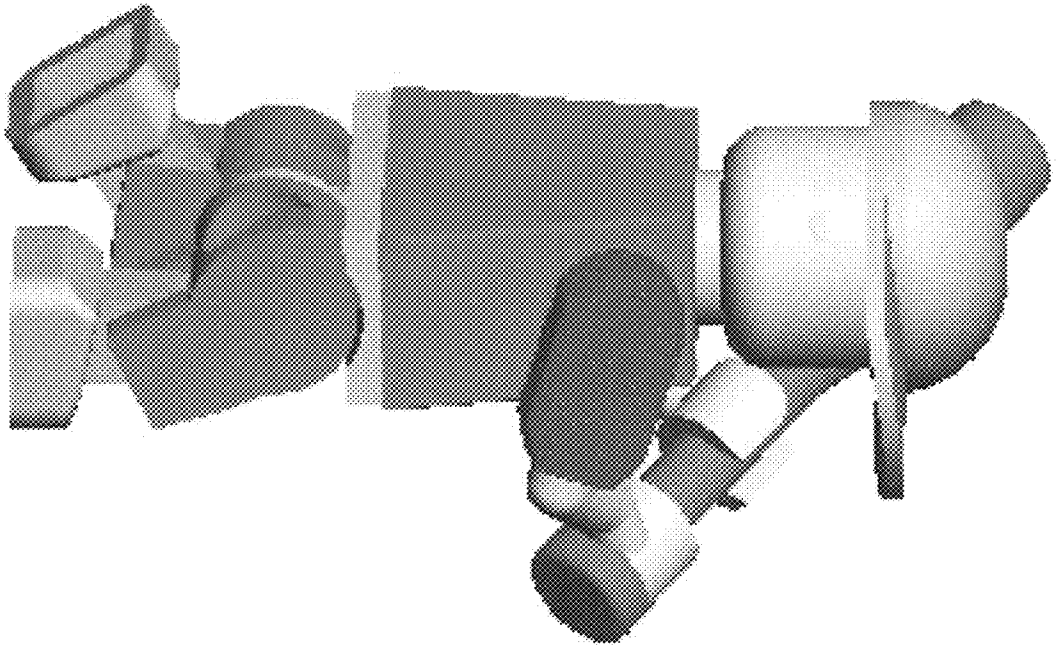
FIG. 53 shows a side view of a baseball mini-figure holding a bat.
Figure 54:
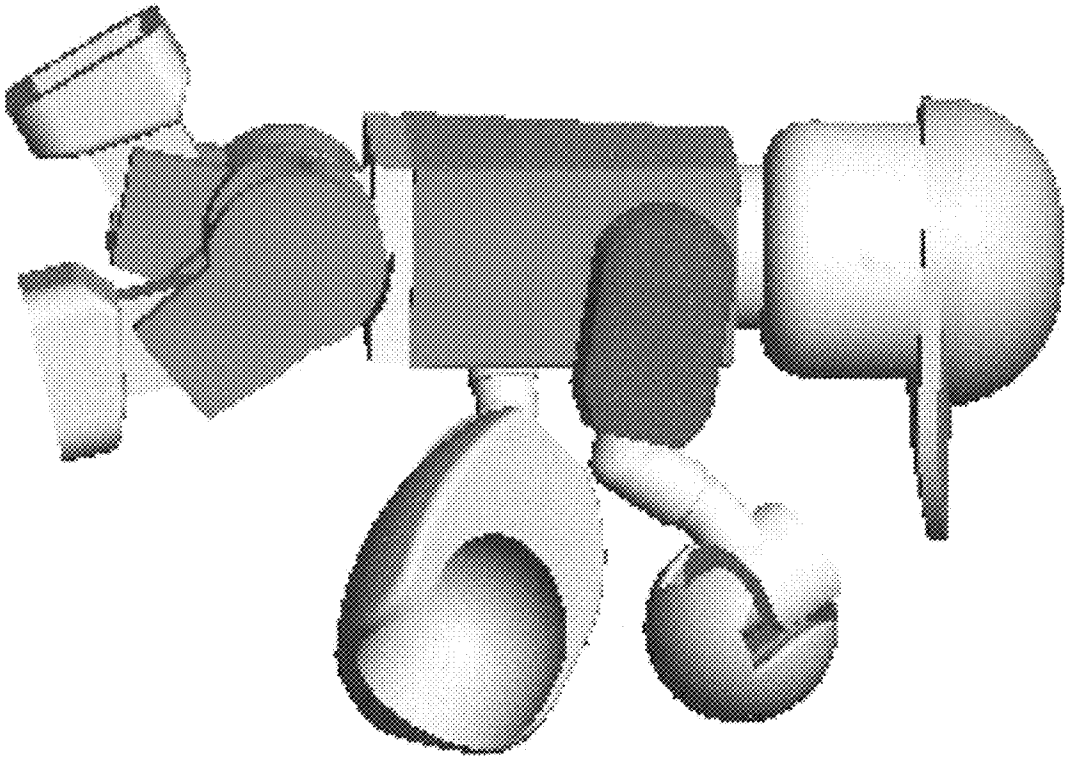
FIG. 54 shows a side view of a baseball mini-figure holding a glove and a ball.
Figure 55:
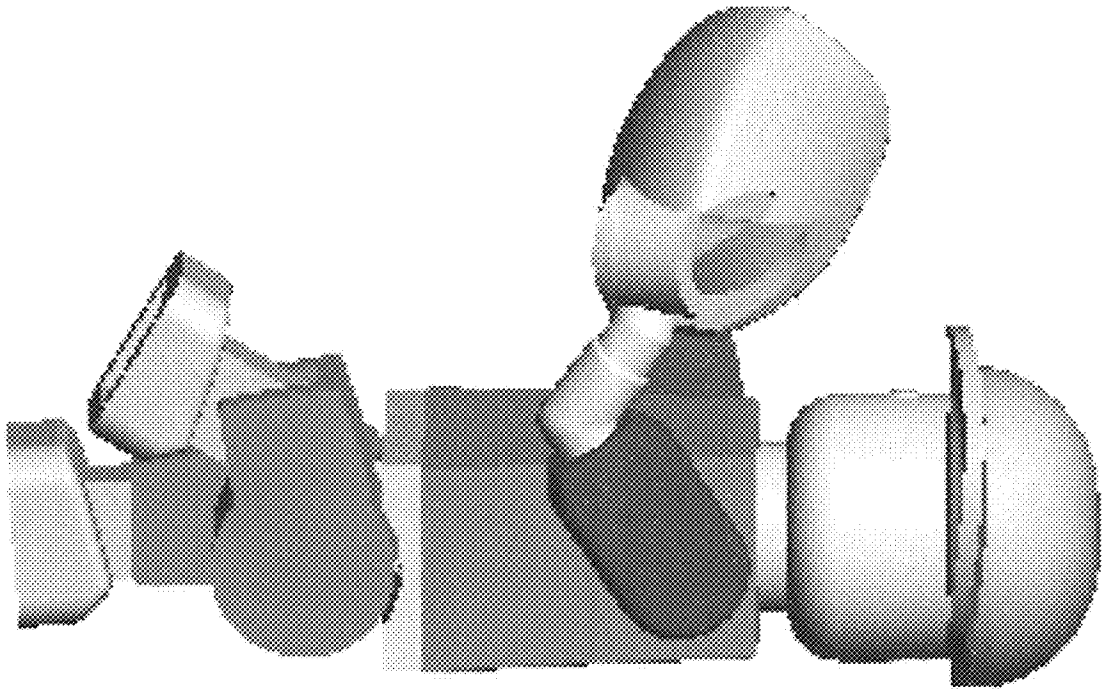
FIG. 55 shows a side view of a baseball mini-figure with glove in a pitching position.
Figure 56:
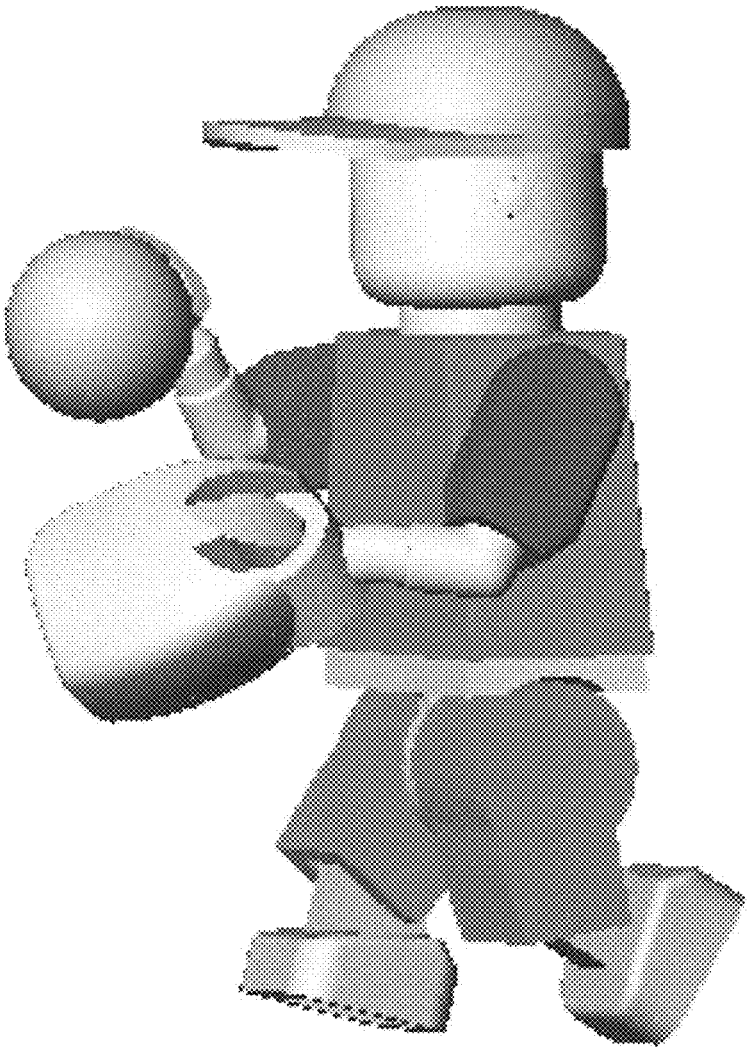
FIG. 56 shows a front view of a baseball mini-figure holding a glove and ball and in a throwing position.
Figure 57:
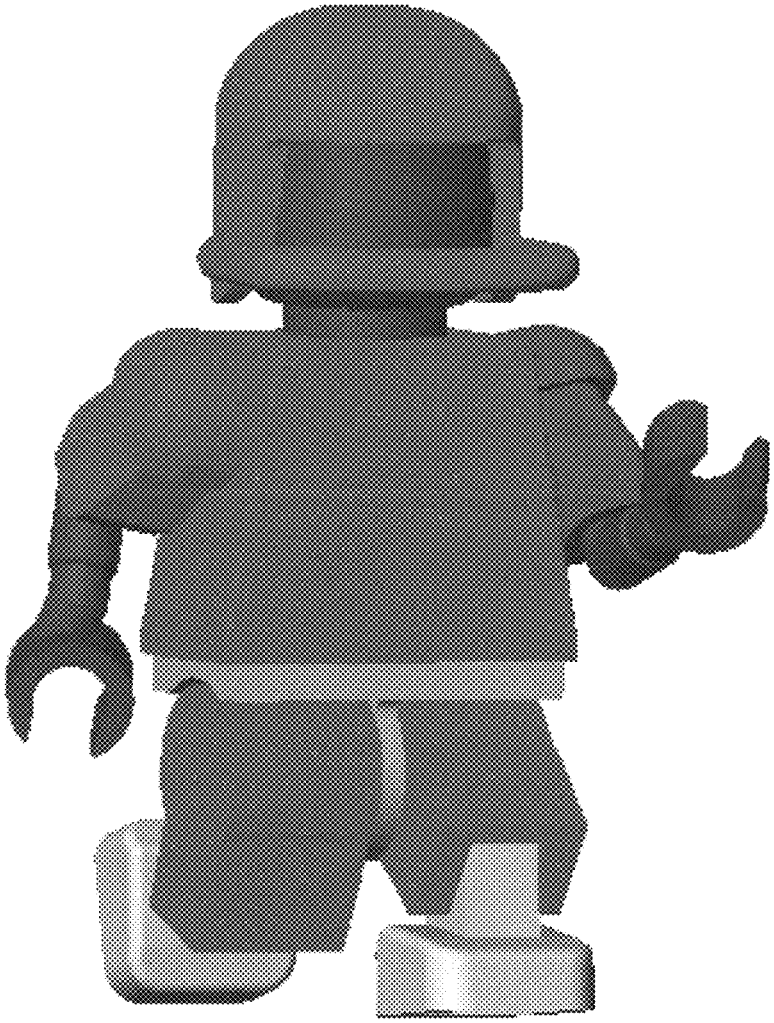
FIG. 57 shows a football mini-figure.
Figure 58B:
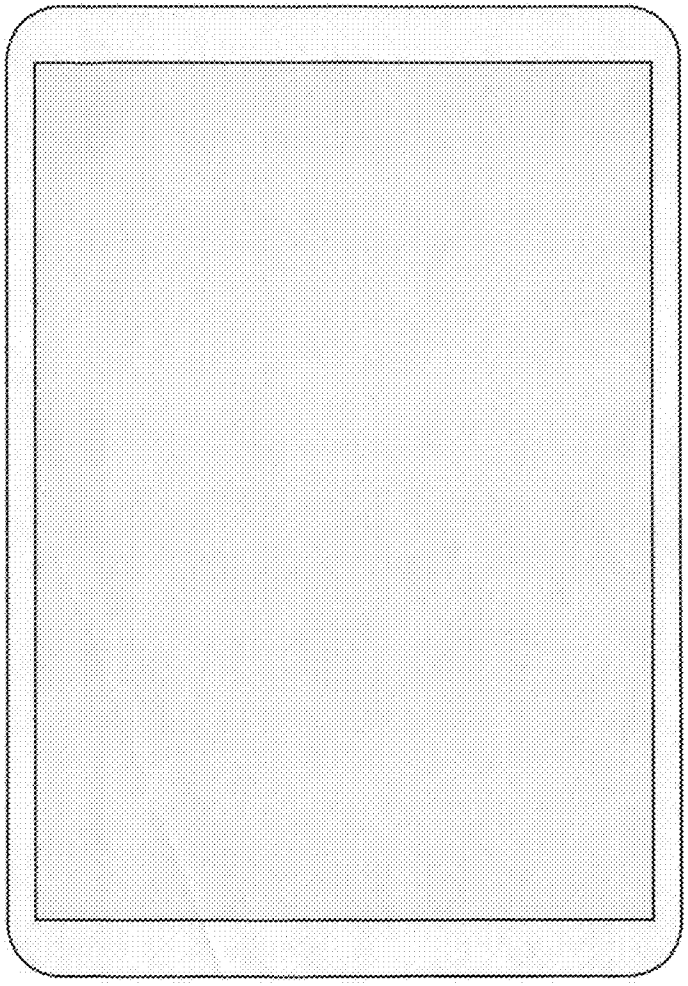
FIGS. 58A-B show packaging for a mini-figure sales display case, with visible card having a display side, FIG. 58A, and a back side, FIG. 58B.
Figure 58A:
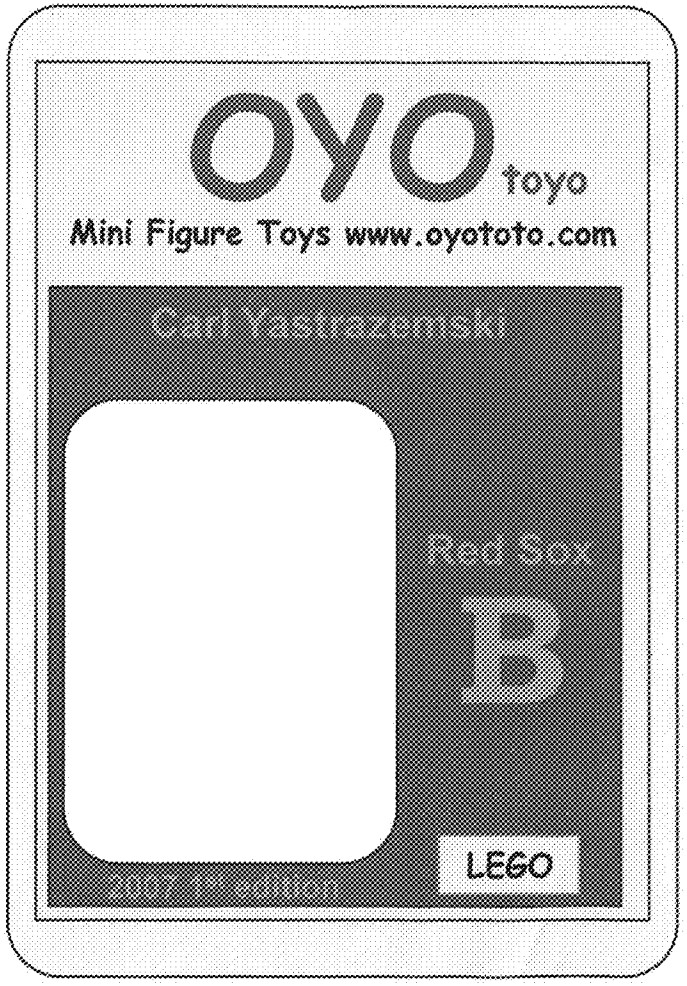
Figure 59:
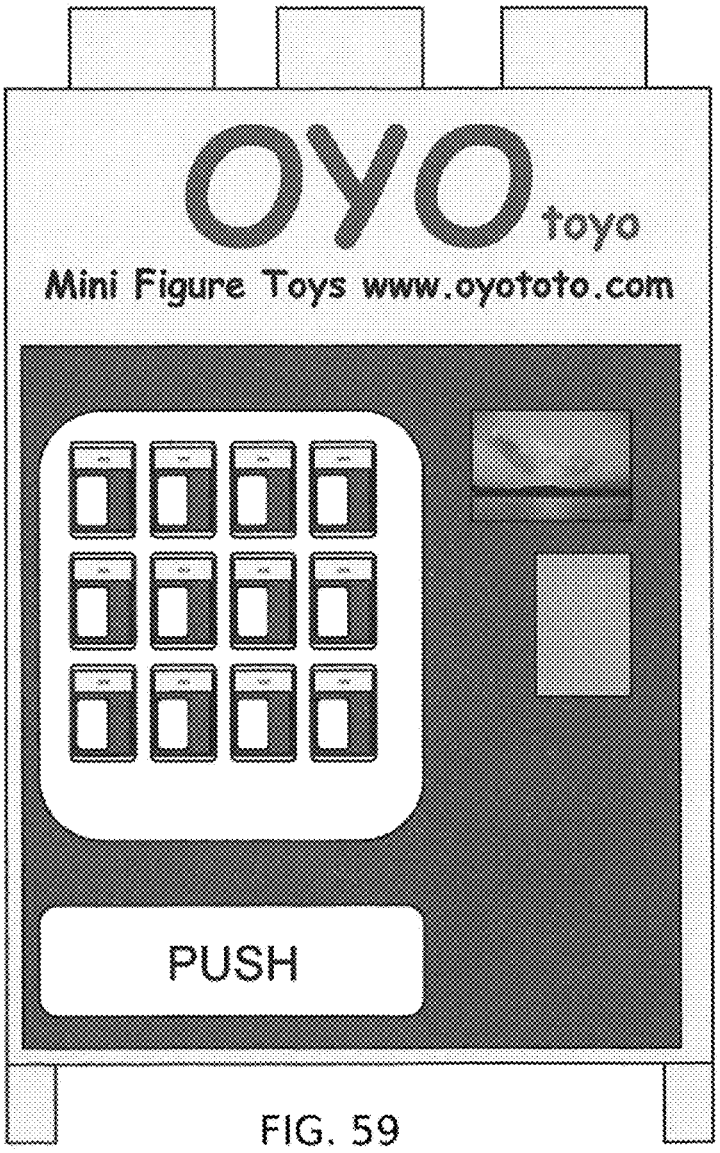
FIG. 59 shows a vending machine for mini-figures.
Figure 60A:
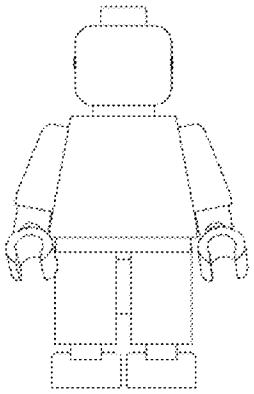
FIGS. 60A-H shows multiple perspective views of a mini-figure with multi-component arms and separate component legs and feet.
Figure 60B:
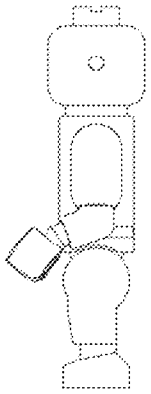
Figure 60C:
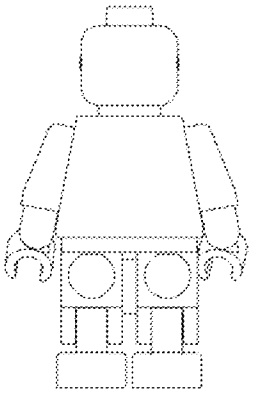
Figure 60D:
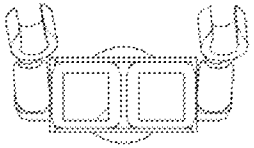
Figure 60E:
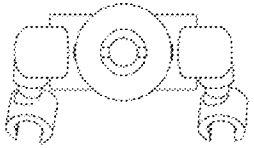
Figure 60F:
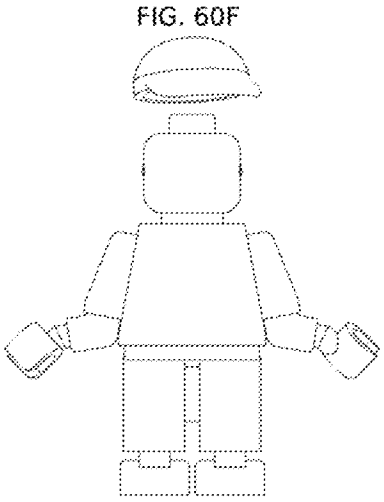
Figure 60G:
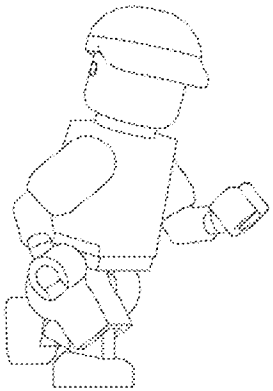
Figure 60H:
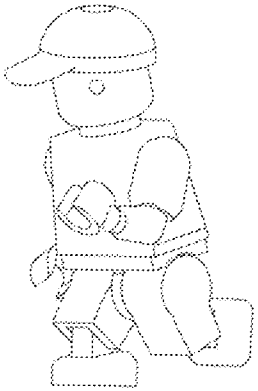
Figure 61C:
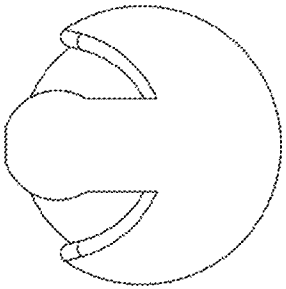
FIGS. 61A-C show multiple perspective views of a ball accessory.
Figure 61B:
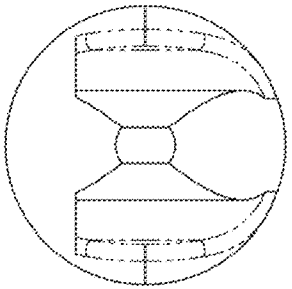
Figure 61A:
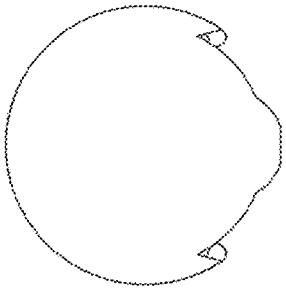
Figure 62B:
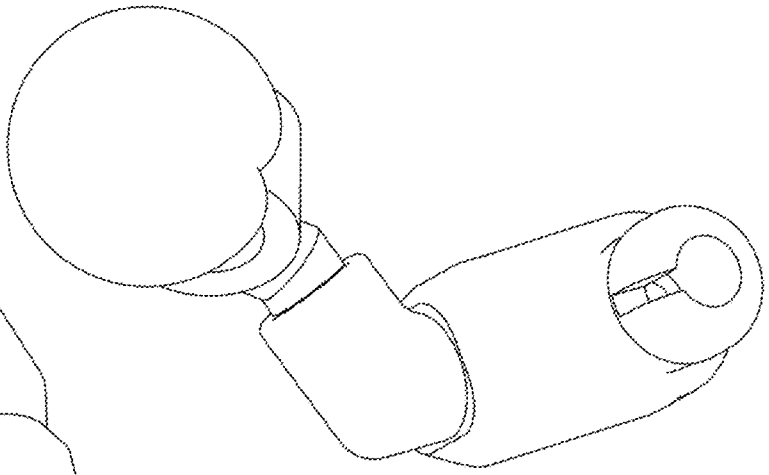
FIGS. 62A-B show multiple views of a multi-component arm connected to a ball.
Figure 62A:
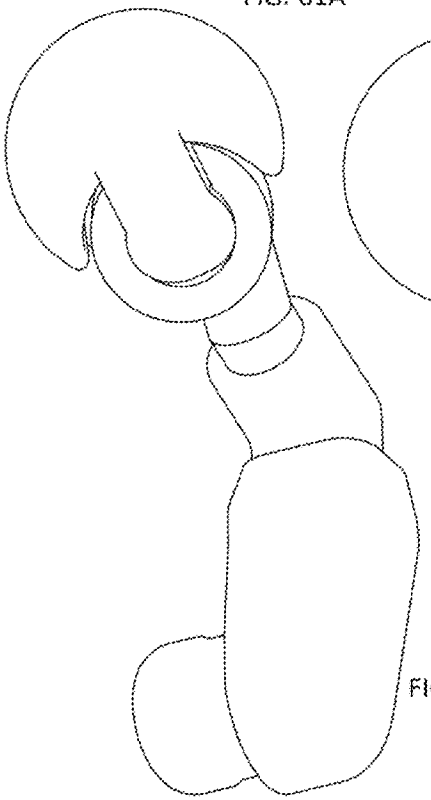
Figure 64A:
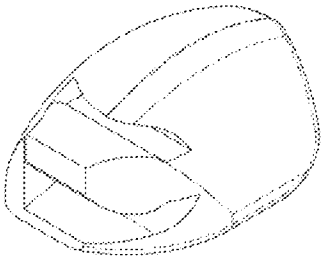
FIGS. 64A-I show multiple perspective views of a glove accessory.
Figure 64B:
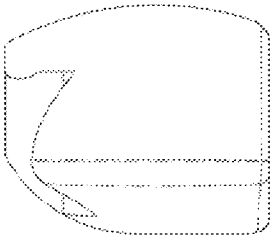
Figure 64C:
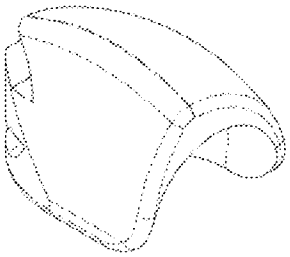
Figure 64D:
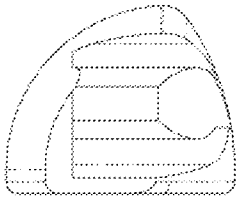
Figure 64E:
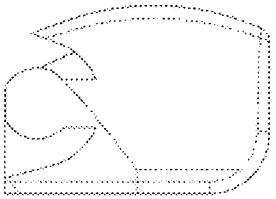
Figure 64F:
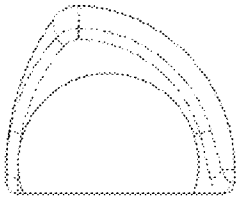
Figure 64G:
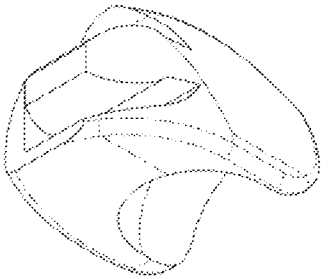
Figure 64H:
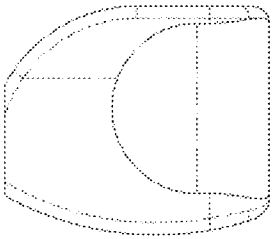
Figure 64I:
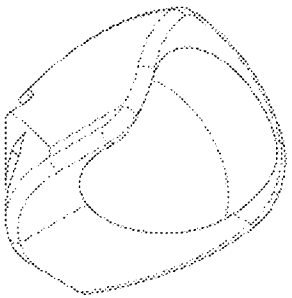

Referring also to FIG. 8, specific features of individual athletes, such as facial features, uniform numbers, name, or statistics may be included on individual components. This allows identifying each individual component with a specific player represented by a mini-figure. An unique number or serial number may be included for collectibility purposes. Referring also to FIGS. 36 and 37, Such marking may be done using a printer that prints directly on components and may be done individually, as a set, or on assembled mini-figures. The printer may have a tray for holding at least one figure allowing the components to be marked as a serialized set. This may also allow an array of figures to be printed during the same print with or without any variations in the array. For example, components may be arranged by sports team and skin tone, configured in an array of trays and printed in batches allowing rapid change and reproduction during a sports season. Alternatively, an individualized printer may hold one mini-figure having specific team markings. A user interface may select name and number to print on the specific mini-figure. Such customization may be done at a manufacturing facility, or at an end-sales location such as a store controlled by a purchaser or sales attendant.

Figure 24A:
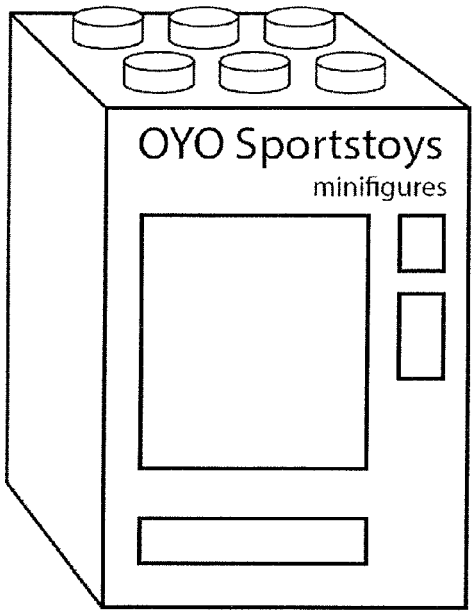
FIG. 24A shows a vending machine and FIG. 24B shows a point-of-purchase display.
Figure 24B:
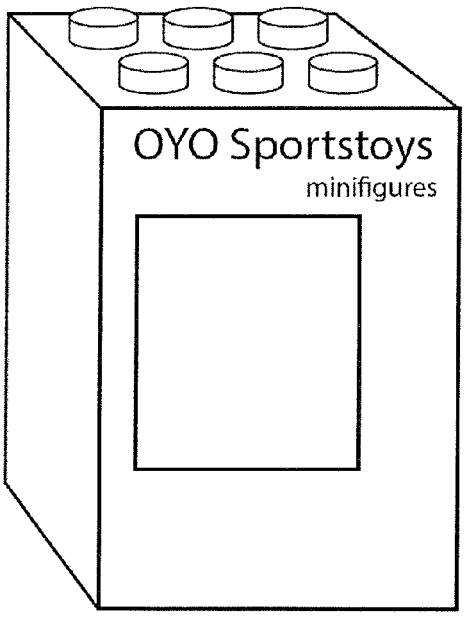
Figure 25:
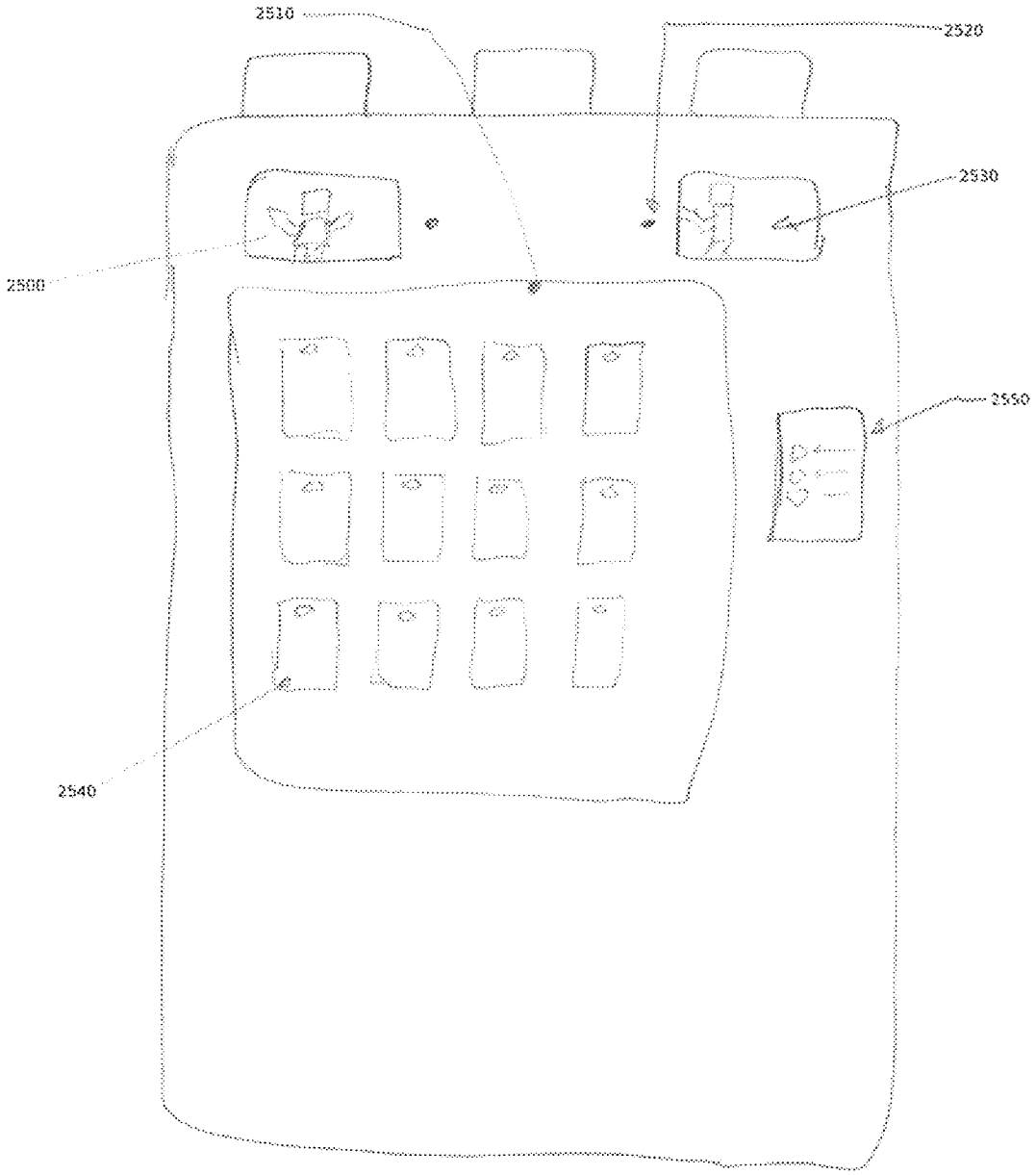
FIG. 25 shows a vending machine with interactive display.

In addition to customization by end-purchasers, referring also to FIGS. 24 and 25 another method to better enable the distribution of the mini-figures is to provide an easily identifiable display. Such display may include a housing structure for organizing packaged mini-figures and an interactive interface to attract customers. The interface may be motion sensitive to direct audio to customers passing by. The audio may be preprogrammed or instant communication fed through wireless or remote locations. As shown in FIG. 25, a mini-figure may be displayed 2500 with audio output as discussed above, such as saying "HEY! Let me out of here!" or "Welcome to the Boladrome!" Motion sensor 2520 may detect when anyone approaches, triggering the audio. RFID sensor 2510 may detect when mini-figures are purchased, with RFID 2540 included in each mini-figure package. Interactive display 2530 is programmable for different modes to interact with customers, including web-linked ads. Interactive access panel 2550 allows customer interaction, and may include web access to allow search and inventory listings of both the local machine and other machines or displays accessible via the web. An alternative sales display is a matrixed vending machine. This allows a customer to select a player mini-figure and purchase without requiring a store location. The interactive display may be incorporated into the vending machine. The vending machine may be transmit sales and inventory information to a web server allowing online inventory search by owners or customers to identify available mini-figures at specific locations.

It is to be understood that the above description is intended to be illustrative, and not restrictive. Many other embodiments will be apparent to those of skill in the art upon reviewing the above description. The scope of the invention should, therefore, be determined with reference to the appended claims, along with the full scope of equivalents to which such claims are entitled.

What is claimed is:

1. A toy sports figure comprising:

a head component;

a torso component connectable through an interference-fitted cylindrical connection to the head component, the torso component including a first cylindrical opening;

an upper arm component having a cylindrical first portion received in the cylindrical opening of the torso component through an interference-fitted cylindrical connection, movement of the upper arm component relative to the torso component being limited to rotation about a first rotational axis defined by the centerline of the cylindrical opening of the torso component, the upper arm component including a cylindrical opening positioned such that the centerline of the cylindrical opening of the upper arm component intersects the centerline of the cylindrical opening of the torso component;

a forearm component having a cylindrical first portion received in the cylindrical opening of the upper arm component through an interference-fitted cylindrical connection such that the forearm component is moveable along the centerline of the cylindrical opening of the upper arm component and limited to rotation about a second rotational axis defined by the centerline of the cylindrical opening of the upper arm component, the forearm component including a cylindrical opening positioned such that the centerline of the cylindrical opening of the forearm component intersects the centerline of the cylindrical opening of the upper arm component; and a hand component having a cylindrical first portion received in the cylindrical opening of the forearm component through an interference-fitted cylindrical connection, such that the hand component is extendable along the centerline of the cylindrical opening of the forearm and limited to rotation about a third rotational axis defined by the centerline of the cylindrical opening of the forearm component;

wherein movement of the forearm component along the centerline of the cylindrical opening of the upper arm component changes the distance between the first axis of rotation and the third axis of rotation.

2. The sports toy figure of claim 1, wherein the torso component has a top, a bottom, a front having a generally planar surface, a back having a generally planar surface, a first side having a generally planar surface, and a second side having a generally planar surface, the front and back each having first width adjacent the top which is smaller than a second width measured adjacent the bottom.

3. The sports toy figure of claim 2, wherein the first cylindrical opening is formed in the first side with the centerline of the first cylindrical opening being normal to the generally planar surface of the first side.

4. The sports toy figure of claim 3, wherein a second cylindrical opening is formed in the second side with the centerline of the second cylindrical opening being normal to the generally planar surface of the second side, and wherein the centerline of the first cylindrical opening is not parallel to the centerline of the second cylindrical opening.

5. The sports toy figure of claim 4, wherein the sports toy figure includes a first upper leg component and a second upper leg component, each upper leg component configured to pivot relative to the torso component about a fourth rotational axis.

6. The sports toy figure of claim 5, wherein the cylindrical first portion of the forearm component has a first segment and a second segment, the first segment having a first diameter and the second segment having a second diameter larger than the first, the second diameter being larger than a diameter of the cylindrical opening of the upper arm component.

7. The sports toy figure of claim 6, wherein the cylindrical first portion of the forearm component has a third segment positioned on the opposite side of the second segment from the first segment, the third segment having a third diameter equal to the first diameter.

8. The sports toy figure of claim 7, wherein the cylindrical first portion of the hand component has a first segment and a second segment, the first segment having a first diameter and the second segment having a second diameter larger than the first, the second diameter being larger than a diameter of the cylindrical opening of the forearm component.

9. The sports toy figure of claim 8, wherein the cylindrical first portion of the hand component has a third segment positioned on the side opposite of the second segment from the first segment, the third segment having a third diameter equal to the first diameter.

10. The sports toy of figure of claim 7, wherein the hand component includes a grip positioned distally from the cylindrical first portion of the hand component, the grip being offset from the third axis of rotation such that rotation of the hand component about the third axis of rotation causes the hook to revolve about the third axis of rotation.

11. The sports toy figure of claim 1, wherein the cylindrical first portion of the forearm component has a first segment and a second segment, the first segment having a first diameter and the second segment having a second diameter larger than the first, the second diameter being larger than a diameter of the cylindrical opening of the upper arm component.

12. The sports toy figure of claim 11, wherein the cylindrical first portion of the forearm component has a third segment positioned on the opposite side of the second segment from the first segment, the third segment having a third diameter equal to the first diameter.

13. The sports toy figure of claim 1, wherein the cylindrical first portion of the hand component has a first segment and a second segment, the first segment having a first diameter and the second segment having a second diameter larger than the first, the second diameter being larger than a diameter of the cylindrical opening of the forearm component.

14. The sports toy figure of claim 13, wherein the cylindrical first portion of the hand component has a third segment positioned on the opposite side of the second segment from the first segment, the third segment having a third diameter equal to the first diameter.

15. The sports toy of figure of claim 14, wherein the hand component includes a grip positioned distally from the cylindrical first portion of the hand component, the hook being offset from the third axis of rotation such that rotation of the hand component about the third axis of rotation causes the hook to revolve about the third axis of rotation.

16. The sports toy of figure of claim 1, wherein the hand component includes a grip positioned distally from the cylindrical first portion of the hand component, the hook being offset from the third axis of rotation such that rotation of the hand component about the third axis of rotation causes the hook to revolve about the third axis of rotation.

17. The sports toy figure of claim 1, wherein the cylindrical first portion of the forearm component has a first segment, a second segment, and a third segment, the first segment having a first diameter and the second segment having a second diameter larger than the first, the second diameter also being larger than a diameter of the cylindrical opening of the upper arm component, the third segment positioned on the opposite side of the second segment from the first segment, the third segment having a third diameter equal to the first diameter.

18. The sports toy figure of claim 1, wherein the cylindrical first portion of the forearm component is configured to be received in the cylindrical opening of the upper arm component with clearance between the first segment and the cylindrical opening of the upper arm component and where the second segment interferes with the cylindrical opening of the upper arm component while the third segment protrudes from the cylindrical opening of the upper arm component.

19. The sports toy figure of claim 1, wherein the second segment engages the cylindrical opening of the upper arm component in an interference fit for at least the length of the third segment.

20. The sports toy figure of claim 1, wherein the cylindrical first portion of the hand component is configured to be received in the cylindrical opening of the forearm component with clearance between the first segment and the cylindrical opening of the forearm component and where the second segment interferes with the cylindrical opening for at least the length of the third segment.

* * * * *